US007409167B2

(12) United States Patent
Inukai

(10) Patent No.: US 7,409,167 B2
(45) Date of Patent: Aug. 5, 2008

(54) IMAGE-FORMING DEVICE CAPABLE OF PERFORMING SELF-DIAGNOSIS USING INSPECTION CARTRIDGE IN PLACE OF PROCESS CARTRIDGE

(75) Inventor: Katsumi Inukai, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 56 days.

(21) Appl. No.: 11/200,882

(22) Filed: Aug. 9, 2005

(65) Prior Publication Data

US 2006/0034623 A1 Feb. 16, 2006

(30) Foreign Application Priority Data

Aug. 10, 2004 (JP) ..... 2004-233432

(51) Int. Cl.
*G03G 15/00* (2006.01)

(52) U.S. Cl. ..... 399/9; 399/11

(58) Field of Classification Search ..... 399/9, 399/11

See application file for complete search history.

(56) References Cited

U.S. PATENT DOCUMENTS

| | | | | |
|---|---|---|---|---|
| 4,642,448 | A * | 2/1987 | Shigemura et al. | 219/216 |
| 6,400,462 | B1 * | 6/2002 | Hille | 358/1.14 |
| 6,744,998 | B2 * | 6/2004 | McIntyre | 399/81 |
| 7,050,892 | B1 * | 5/2006 | Liebl et al. | 701/29 |
| 2002/0135655 | A1 * | 9/2002 | Ameyama et al. | 347/129 |
| 2006/0050334 | A1 * | 3/2006 | Hille et al. | 358/504 |
| 2006/0053335 | A1 * | 3/2006 | Hille | 714/4 |

FOREIGN PATENT DOCUMENTS

| | | | |
|---|---|---|---|
| DE | 0075854 | A2 * | 4/1983 |
| JP | 6-87963 | U | 12/1994 |
| JP | 9-264913 | A | 10/1997 |
| JP | 2002-283683 | A | 10/2002 |
| JP | 2003-33022 | A | 1/2003 |

OTHER PUBLICATIONS

Patent Abstracts of Japan for 06-087963 published on Mar. 29, 1994.

* cited by examiner

*Primary Examiner*—Quana M Grainger
(74) *Attorney, Agent, or Firm*—Darby & Darby P.C.

(57) ABSTRACT

A laser printer having a self-diagnostic function includes a first sensing unit that changes in detection status when one of a process cartridge and an inspection cartridge is mounted therein, and a second sensing unit that changes in detection status when at least the other of the process cartridge and inspection cartridge is mounted therein. A control unit of the laser printer identifies the type of cartridge mounted in the laser printer based on detection results from the first and second sensing units and switches the operating mode of the laser printer from a normal mode for performing image-forming operations to a self-diagnostic mode for diagnosing the status of its components when the control unit determines that the inspection cartridge is mounted in the laser printer.

18 Claims, 20 Drawing Sheets

NORMAL PROCESS CARTRIDGE

INSPECTION CARTRIDGE

NORMAL PROCESS CARTRIDGE

INSPECTION CARTRIDGE

IMAGE-FORMING DEVICE CAPABLE OF PERFORMING SELF-DIAGNOSIS USING INSPECTION CARTRIDGE IN PLACE OF PROCESS CARTRIDGE

INCORPORATION BY REFERENCE

The present application claims priority under 35 U.S.C. §119 to Japanese Patent Application No. 2004-233432 filed on Aug. 10, 2004. The content of the application is incorporated herein by reference in its entirety.

BACKGROUND OF THE INVENTION

1. Field of the Invention

The present invention relates to an image-forming device for forming images on a recording medium.

2. Description of the Related Art

Image-forming devices having a function for detecting abnormalities and the like in the operating state of the device, such as that disclosed in Japanese Utility Model Application Publication No. HEI-6-87963, are well known in the art. With these image-forming devices, an external operation can be performed to switch the operating mode of the image-forming device between an image-forming mode for forming images on a recording medium and a self-diagnostic mode for performing a self-diagnosis of various components in the image-forming device.

However, since the operating mode of the image-forming device described above is switched according to an external operation, if the user of the image-forming device mistakenly performs the external operation, the operating mode is switched against the user's wishes. To avoid this, attempts have been made to make the sequence or combination of external operations more complex so that the operating mode is not shifted by accident. However, these countermeasures complicate the operations required to change the operating mode to the self-diagnostic mode.

SUMMARY

In view of the foregoing, it is an object of the present invention to provide an image-forming device having a self-diagnostic function for diagnosing components of the image-forming device and that is capable of preventing a switch in operating modes due to an incorrect operation by the user, without increasing the complexity for switching modes.

The above and other objects will be attained by an image-forming device according to one aspect of the present invention for forming images on a recording medium, the image-forming device comprising a photosensitive member; charging unit for charging a surface of the photosensitive member; exposing unit for forming an electrostatic latent image on the photosensitive member after the photosensitive member has been charged by the charging unit; developing unit for developing the latent image formed on the photosensitive member into a visible image using a developer; and transferring unit for transferring the visible image developed by the developer onto the recording medium. The image-forming device is configured so that an inspection member can be detachably mounted therein. The image-forming device further comprises driving unit for driving at least one of the charging unit, the developing unit, and the transferring unit as a target unit to be driven; switching unit for switching an operating mode of the image-forming device from a normal mode for forming images on the recording medium to a self-diagnostic mode for performing a self-diagnosis on the state of the image-forming device based on whether the inspection member is mounted in the image-forming device; drive commanding unit for commanding the driving unit to drive the target unit to be driven by outputting a self-diagnostic drive command to the driving unit when the switching unit has switched the drive mode of the image-forming device to the self-diagnostic mode; and a diagnosing unit for determining whether an operating state of the driving unit is normal based on drive commands received from the drive commanding unit.

Specifically, the switching unit switches the operating mode of the image-forming device from the normal mode for forming images to the self-diagnostic mode for diagnosing the status of the image-forming device based on whether the inspection member is mounted in the image-forming device. The diagnosing unit determines whether the operating status of the driving unit is normal based on drive commands outputted from the drive commanding unit.

Accordingly, the operating mode of this image-forming device can be switched based on whether the inspection member is mounted in the image-forming device, thereby preventing incorrect operations by the user. The image-forming device also eliminates the time and effort required to perform tedious external operations or command input.

According to another aspect of the present invention, if an image-forming cartridge comprising at least one target unit to be driven is detachably mounted in the image-forming device, it is desirable that the driving unit be disposed on a main casing of the image-forming device so as to be capable of connecting electrically to the target unit to be driven provided in the image-forming cartridge when the image-forming cartridge is mounted in the image-forming device.

With this construction, when in the self-diagnostic mode, the image-forming device can diagnose the integrity of an electrical connection at a contact point between the image-forming cartridge and the main casing of the image-forming device. According to another aspect of the present invention, the image-forming device may be configured so that an inspection cartridge can be mounted in the image-forming device in place of the image-forming cartridge as the inspection member. Here, the image-forming device may comprise identifying unit for identifying the type of cartridge mounted. Therefore, it is desirable that the switching unit switch the operating mode of the image-forming device to the self-diagnostic mode when the identifying unit identifies the mounted cartridge to be an inspection cartridge, and to the normal mode when the identifying unit identifies the mounted cartridge to be the image-forming cartridge.

With this construction, the image-forming device can operate in the self-diagnostic mode when the inspection cartridge is mounted in place of the image-forming cartridge. Hence, the image-forming device can perform a diagnosis that is not possible when the image-forming cartridge is mounted in the image-forming device (such as a diagnosis that outputs a higher voltage).

Further, since the image-forming device selects the self-diagnostic mode only when the inspection cartridge is mounted, the same inspection cartridge can be used on a plurality of image-forming devices. This is useful when performing inspections on a plurality of image-forming devices at a site for mass-producing image-forming devices, for example.

Here, the target unit to be driven provided in the image-forming cartridge need not be included in the inspection cartridge. In other words, the image-forming device can be configured so that images cannot be formed on a recording medium when the inspection cartridge is mounted therein.

According to another aspect of the present invention, it is desirable that the inspection cartridge be configured with smaller electrical resistances than those in the target unit to be driven provided in the image-forming cartridge.

This construction enables a larger current to be used during inspections, thereby improving inspection sensitivity when performing conduction tests.

According to another aspect of the present invention, the inspection cartridge should have an internal state different from that of the image-forming cartridge, so that the identifying unit can identify the type of the cartridge by detecting the internal state of the cartridge mounted in the image-forming device.

Since the identifying unit can detect differences in the internal state of a cartridge according to the type of cartridge, the image-forming device having this construction can determine the type of cartridge reliably.

According to another aspect of the present invention, the identifying unit of the image-forming device comprises a new product detecting unit for detecting whether the cartridge mounted in the image-forming device is new; and a developer detecting unit for detecting whether the cartridge mounted in the image-forming device contains developer. The identifying unit determines that an inspection cartridge is mounted in the image-forming device when the new product detecting unit detects that the cartridge is new and the developer detecting unit determines that the cartridge does not contain developer. Here, it is preferable that the image-forming cartridge be detected based on the usage state of the cartridge, while the inspection cartridge be detected based on results indicating that the cartridge is new and that the cartridge does not contain developer, rather than based on the usage state of the cartridge.

In other words, the image-forming device having this construction determines the type of cartridge mounted therein based on detection results by the new product detecting unit and the developer detecting unit that detect the internal state of the image-forming cartridge.

Hence, since the new product detecting unit and the developer detecting unit for detecting the internal state of the cartridge mounted in the image-forming device are used as means for identifying the type of cartridge, the image-forming device can identify the type of cartridge without providing new means for that purpose.

While the identifying unit may be configured to detect the internal state of the cartridge mounted in the image-forming device as described above, according to another aspect of the present invention, the identifying unit comprises first cartridge detecting unit for changing a detection status when one of the image-forming cartridge and the inspection cartridge is mounted in the image-forming device; and second cartridge detecting unit for changing a detection status when at least the other of the image-forming cartridge and the inspection cartridge is mounted in the image-forming device. This image-forming device may be configured to identify the type of cartridge mounted therein based on detection results by the first and second cartridge detecting unit.

With this construction, the first and second cartridge detecting unit of the image-forming device can determine the type of cartridge simply by modifying the shape of each cartridge according to the type of cartridge, thereby using a more simple construction to identify the type of cartridge mounted in the image-forming device.

According to another aspect of the present invention, the first and second cartridge detecting unit are disposed along a conveying path on which the recording medium is conveyed. The image-forming device can detect the position of the recording medium from changes in the detection status when the recording medium passes a position on the conveying path. The first cartridge detecting unit is disposed downstream of the second cartridge detecting unit with respect to the direction in which the recording medium is conveyed, and the detection status is changed when the image-forming cartridge is mounted in the image-forming device. The identifying unit should identify the type of cartridge mounted in the image-forming device as the inspection cartridge when the detection status is changed by the first cartridge detecting unit but not changed by the second cartridge detecting unit.

With this construction, the first and second cartridge detecting unit of the image-forming device are used as means for detecting the position of the recording medium. Hence, the image-forming device can detect the position of the recording medium without providing new means for that purpose.

According to another aspect of the present invention, the driving unit comprises voltage applying unit for applying a drive voltage to the target unit to be driven. The drive commanding unit should output a self-diagnostic drive command for commanding the drive voltage applying unit to output a voltage of a size not outputted during the normal mode.

When the driving unit drives a plurality of target unit to be driven, the drive commanding unit should output a drive command to the voltage applying unit that commands the voltage applying unit to output a combination of voltages not output during the normal mode to each of the target unit to be driven.

More specifically, the drive commanding unit directs the voltage applying unit to generate a high voltage that is not outputted when the operating mode of the image-forming device is in the normal mode. Further, when the driving unit drives a plurality of target unit to be driven, the drive commanding unit fixes the output for a certain target unit to be driven to a constant potential not used during the normal mode, and directs the voltage applying unit to generate output for the other target unit to be driven.

Hence, the image-forming device having this construction can output a voltage not used in the normal mode in order to perform a diagnosis under conditions conducive to measurements with the diagnostic unit. Accordingly, the diagnostic unit can perform measurements with improved precision.

In the image-forming device having the construction described above, results of a diagnosis performed by the diagnostic unit are stored in the image-forming device so as to be accessible from an external device. However, according to another aspect of the present invention, the image-forming device may further comprise reporting unit for reporting externally the results of diagnoses performed by the diagnostic unit.

Accordingly, the image-forming device having this construction can report diagnostic results without the use of an external device.

According to another aspect of the present invention, the image-forming device preferably comprises storing unit for storing results of diagnoses performed by the diagnostic unit; and transmitting unit for transmitting diagnostic results stored in the storing unit externally.

With the image-forming device having this construction, diagnostic results transmitted by the transmitting unit can be viewed externally, allowing the user to take a wide range of steps in response to these results. Since diagnostic results can be easily accumulated in large numbers using this image-forming device, statistics of these diagnostic results can easily be maintained.

According to another aspect of the present invention, when cleaning unit are provided for cleaning the surface of the photosensitive member, the cleaning unit should be included in the target unit to be driven.

With this construction, when the drive mode of the image-forming device is set to the self-diagnostic mode, the image-forming device can perform a self-diagnosis of the cleaning unit.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENTS

An image-forming device according to preferred embodiments of the present invention will be described while referring to the accompanying drawings. In the following description, the terms "upward", "downward", "upper", "lower", "above", "below" and the like will be used throughout the description assuming that the image-forming device is disposed in an orientation in which it is intended to be used.

Figure 1:
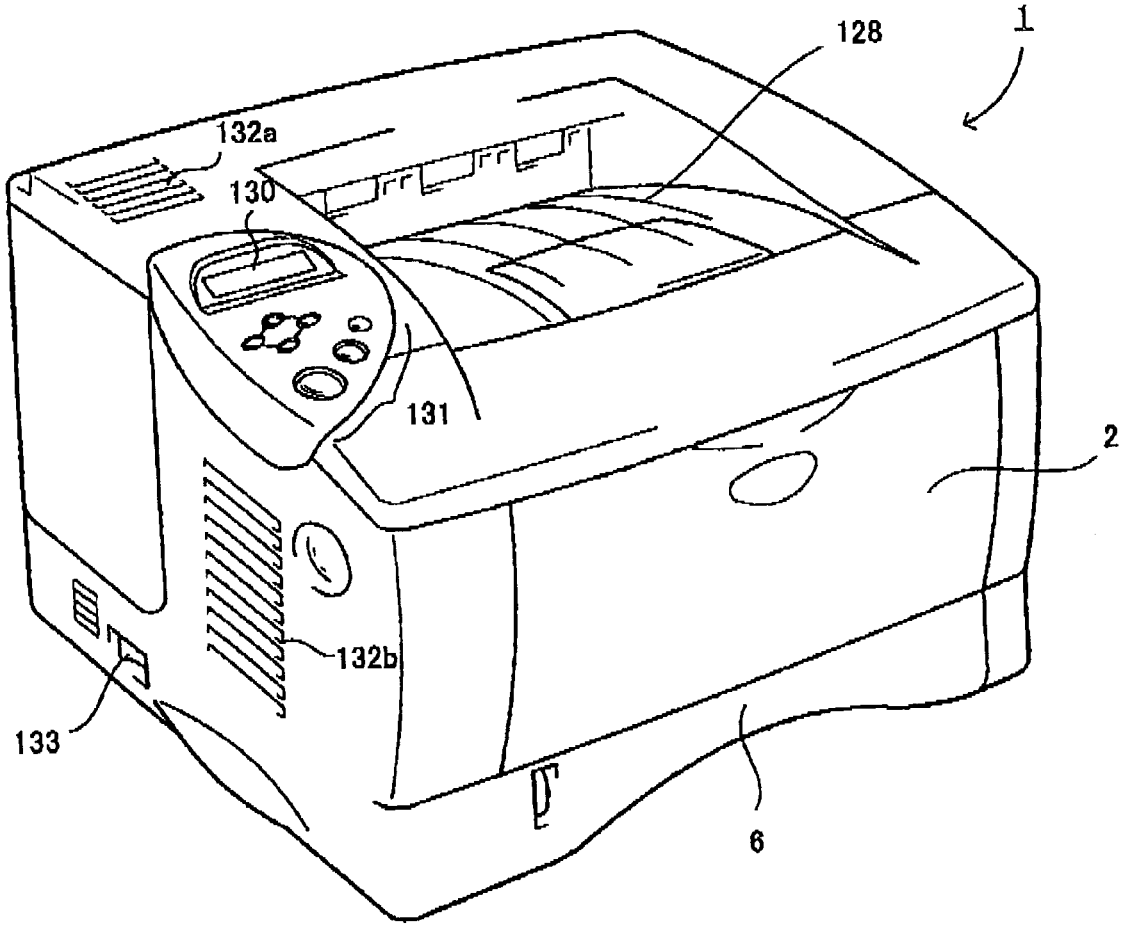
FIG. 1 is a perspective view showing a laser printer according to an embodiment of the invention.

FIG. 1 is a perspective view showing a laser printer 1 according to a first embodiment. As shown in FIG. 1, the laser printer 1 includes a main frame 2, a paper tray 6, a discharge tray 128, ventilating holes 132*a* and 132*b*, a display unit 130 for displaying the status of the laser printer 1, an operating unit 131 for specifying operations of the laser printer 1 and the like, and a power switch 133 for switching the power of the laser printer 1 on and off.

Figure 2:
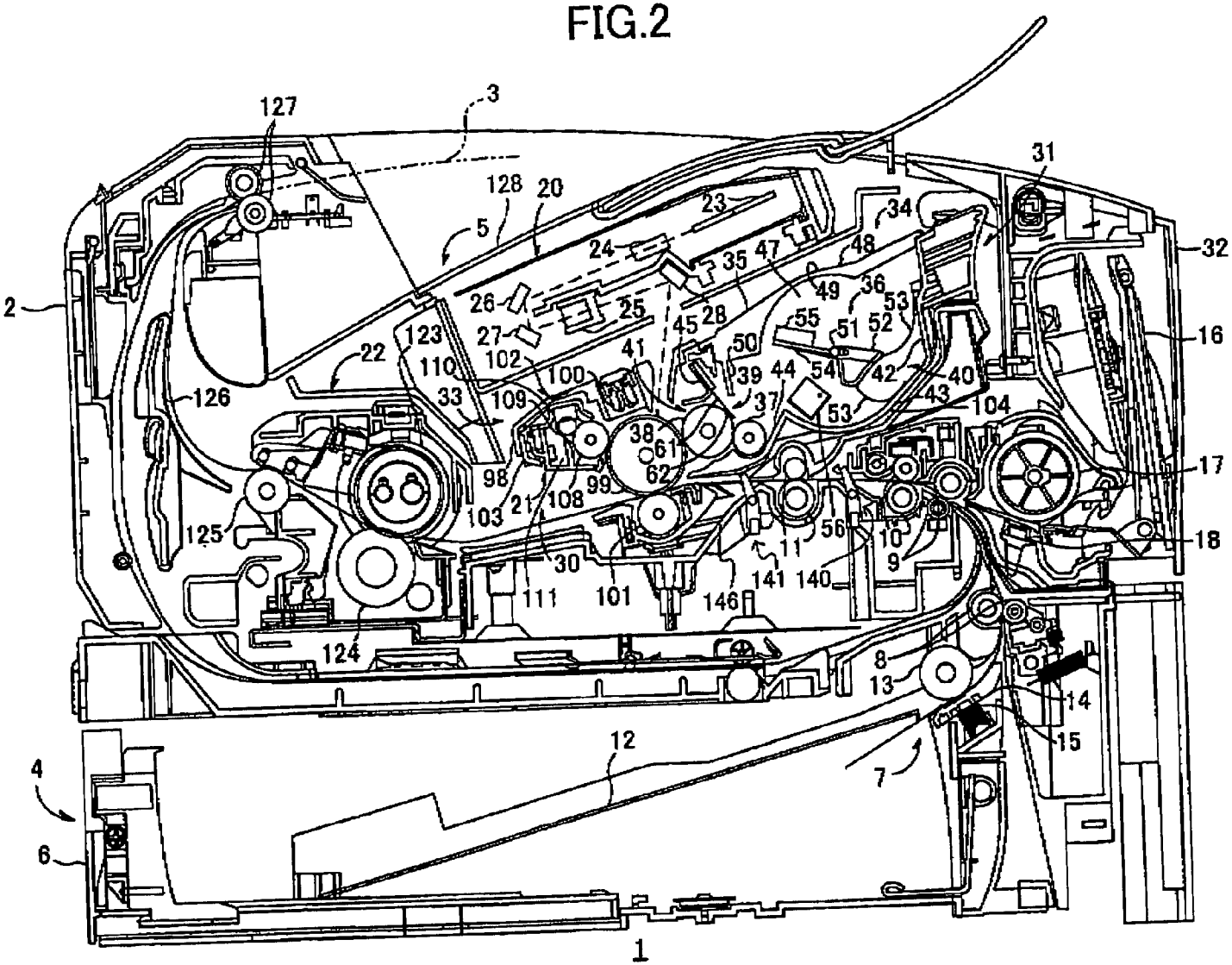
FIG. 2 is a vertical cross-sectional view showing the laser printer shown in FIG. 1.

The paper tray 6 is detachably mounted in the lower section of the main frame 2 and functions to accommodate stacked sheets 3 of paper or another recording medium (see FIG. 2).

The discharge tray 128 functions to support discharged sheets 3 after the laser printer 1 has formed an image thereon.

The ventilating holes 132*a* and 132*b* facilitate the dissipation of heat from the inside of the main frame 2. The ventilating holes 132*a* and 132*b* are configured of numerous elongated holes.

A network interface 154 (see FIG. 13) is disposed on the rear surface of the main frame 2 (a vertical surface near the ventilating hole 132*a* side of the laser printer 1, but not visible in FIG. 1) for connecting the laser printer 1 to a personal computer or other external device. The network interface 154 can connect to a LAN cable, a USB cable, an IEEE 1394 cable, or the like.

Next, the internal structure of the main frame 2 will be described with reference to FIG. 2. FIG. 2 is a side cross-sectional view showing the internal structure of the laser printer 1. The laser printer 1 shown in FIG. 2 is an electrophotographic laser printer that forms images according to a nonmagnetic, single-component developing method. Within the main frame 2, the laser printer 1 includes a feeder unit 4 for supplying the sheets 3, and an image-forming unit 5 for forming images on the sheets 3 supplied from the feeder unit 4.

The feeder unit 4 includes the paper tray 6 that is detachably mounted in the bottom section of the main frame 2, a paper feeding mechanism 7 disposed on one side end of the paper tray 6 (hereinafter, this side end will be referred to as the front side, while the opposite side end will be referred to as the rear side), pairs of conveying rollers 8, 9, and 10 disposed downstream of the paper feeding mechanism 7 in a paper conveying direction (the direction in which the sheets 3 are conveyed), and registration rollers 11 disposed downstream of the pairs of conveying rollers 8, 9, and 10 in the paper conveying direction.

The paper tray 6 has an open-top box shape that is capable of accommodating stacked sheets 3 of paper or another recording medium. The paper tray 6 can be mounted in or removed from the bottom section of the main frame 2 in a horizontal direction. A paper pressing plate 12 is disposed inside the paper tray 6 for supporting the sheets 3 in a stacked state. An end of the paper pressing plate 12 farthest from the paper feeding mechanism 7 is pivotably supported in the paper tray 6 while the end nearest the paper feeding mechanism 7 is capable of moving vertically. A spring (not shown) is disposed on the underside of the paper pressing plate 12 for urging the paper pressing plate 12 upward. As the amount of sheets 3 stacked on the paper pressing plate 12 increases, the paper pressing plate 12 opposes the urging force of the spring and pivots downward about the end farthest from the paper feeding mechanism 7.

The paper feeding mechanism 7 includes a feeding roller 13, a separating pad 14 disposed in opposition to the feeding roller 13, and a spring 15 disposed on the underside of the separating pad 14. The urging force of the spring 15 presses the separating pad 14 toward the feeding roller 13.

As the spring urges the paper pressing plate 12 upward, the topmost sheet 3 on the paper pressing plate 12 is pressed toward the feeding roller 13. As the feeding roller 13 rotates, the leading edge of the sheet 3 becomes interposed between the feeding roller 13 and the separating pad 14 and is separated one sheet at a time by the cooperative operations of the feeding roller 13 and separating pad 14. The separated sheet 3 is conveyed by the conveying rollers 8, 9, and 10 to the registration rollers 11.

The pair of registration rollers 11 align the sheet 3 so that the sheet 3 is traveling in a straight path, and convey the sheet 3 to an image-forming position (an area of contact between a photosensitive drum 99 and a transfer roller 101 described later).

A sensing unit 140 disposed near the feeding roller 13 detects the presence of the sheet 3. A control unit 150 (see FIG. 13) described later controls operations to drive and halt the registration rollers 11 based on a detection timing in which the sensing unit 140 detects the sheet 3.

A sensing unit 141 is disposed along the paper conveying path at a position between the registration rollers 11 and the image-forming position. As with the sensing unit 140 described above, the sensing unit 141 is provided to detect the presence of the sheet 3.

The sensing unit 140 and sensing unit 141 are mechanical devices having a lever 142 (see FIG. 11) positioned to contact the sheet 3. When the leading edge of the sheet 3 pushes the lever 142, the lever 142 is displaced from an original prescribed position prior to the contact. The sensing unit 140 and sensing unit 141 will be described in greater detail later.

The feeder unit 4 of the laser printer 1 also includes a multipurpose tray 16 in which sheets 3 of a desired size can be stacked, a multipurpose feeding roller 17 for supplying the sheets 3 stacked on the multipurpose tray 16, and a multipurpose separating pad 18 disposed in opposition to the multipurpose feeding roller 17. The multipurpose tray 16 is foldable so as to be accommodated in a front cover 32 described later.

The image-forming unit 5 includes a scanning unit 20, a process cartridge 21, and a fixing unit 22.

The scanning unit 20 is disposed in the upper section of the main frame 2 and includes a laser light-emitting unit (not shown), a polygon mirror 23 that is driven to rotate, lenses 24 and 25, and reflecting mirrors 26, 27, and 28.

The laser light-emitting unit emits a laser beam that is modulated according to image data. As indicated by the broken line, the laser beam passes through or is reflected off the polygon mirror 23, lens 24, reflecting mirrors 26 and 27, lens 25, and reflecting mirror 28 in the order given and is irradiated on the surface of a photosensitive drum 99 provided in the process cartridge 21 described later.

The process cartridge 21 is detachably mounted in the main frame 2 at a position below the scanning unit 20. In addition, an inspection cartridge 180 (see FIG. 15) can be detachably mounted in place of the process cartridge 21. Hence, the inspection cartridge 180 has nearly the same shape as the process cartridge 21. However, the internal structure of the inspection cartridge 180 is completely different from that of the process cartridge 21. For example, the inspection cartridge 180 does not include the photosensitive drum 99 and the transfer roller 101 and the like, but is provided only with resistors 180*a*-180*d* described later.

Here, the laser printer 1 will be described while assuming that the process cartridge 21 is mounted therein. A description of the inspection cartridge 180 will be given later.

The main frame 2 includes a cartridge-accommodating unit 30 for accommodating the process cartridge 21; an opening 31 exposing and in communication with the cartridge accommodating-unit 30 through which the process cartridge 21 is inserted into or removed from the main frame 2; and the front cover 32 for covering or exposing the opening 31.

The cartridge-accommodating unit 30 functions as a space below the scanning unit 20 capable of accommodating the process cartridge 21. The opening 31 is a passage formed between the cartridge-accommodating unit 30 and the front cover 32. The front cover 32 is disposed on the front side of the main frame 2 and spans from the front surface to the top surface of the main frame 2. The front cover 32 is capable of swinging between an open position and a closed position so as to expose the opening 31 in the open position and cover the opening 31 in the closed position.

Figure 3:
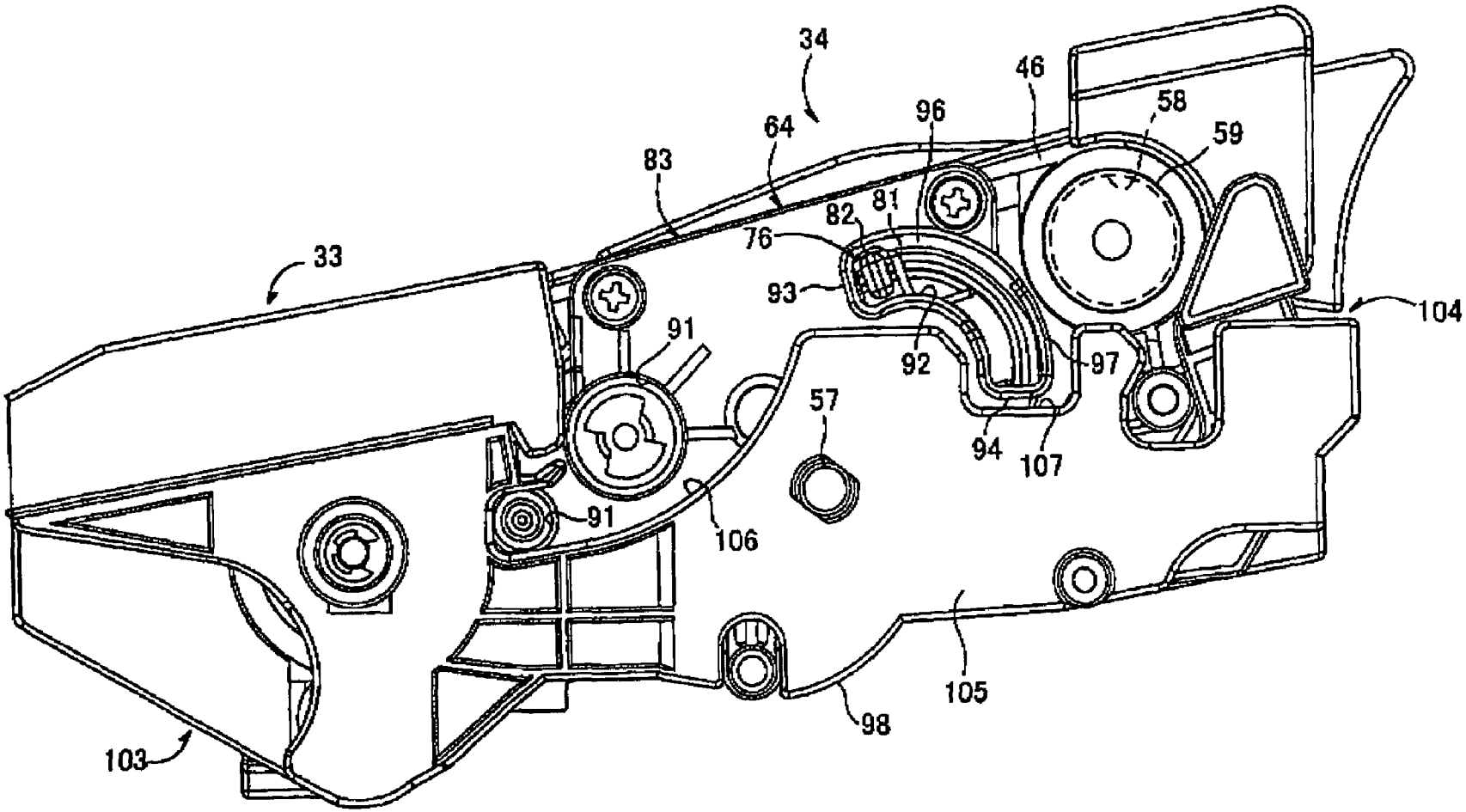
FIG. 3 is a side view showing a process unit used in the laser printer shown in FIG. 1.

The process cartridge 21 can be inserted into or removed from the cartridge-accommodating unit 30 via the opening 31 when the front cover 32 is in the open position. As shown in FIG. 3, the process cartridge 21 includes a drum cartridge 33 detachably mounted in the main frame 2, and a developing cartridge 34 that is detachably mounted on the drum cartridge 33.

As shown in FIG. 2, the developing cartridge 34 includes a casing 35, an agitator 36 provided in the casing 35, a supply roller 37, a developing roller 38, and a thickness regulating blade 39.

The casing 35 includes a front wall 42, a bottom wall 43 that curves rearward from the bottom edge of the front wall 42, a lower wall 44 extending rearward from the rear edge of the bottom wall 43, and a blade support wall 45 formed above the lower wall 44.

Side walls 46 and 47 provided on both widthwise sides of the casing 35 (where the widthwise direction is orthogonal to the front-to-rear direction) are formed integrally on either side of the front wall 42, bottom wall 43, lower wall 44, and blade support wall 45. The rear side of the casing 35, formed by the lower wall 44, blade support wall 45, side wall 46, and side wall 47, has an opening in which a portion of the developing roller 38 on the rear side is exposed.

A space formed in the front side of the casing 35 and surrounded by the front wall 42, bottom wall 43, and side walls 46 and 47 is a toner accommodating chamber 40. A space formed in the rear side of the casing 35 and surrounded by the lower wall 44, blade support wall 45, and side walls 46 and 47 is a developing chamber 41.

The casing 35 also includes a top cover 48 for covering an open area on the top of the casing 35. The top cover 48 is formed as a separate member from the casing 35 and is integrally formed of an upper plate 49 for covering the opening in the top of the casing 35 and an upper partitioning plate 50 extending downward from the rear edge of the upper plate 49.

The toner accommodating chamber 40 accommodates toner. In the preferred embodiment, the toner is a positively charged nonmagnetic single-component toner. The toner is a polymerized toner obtained by copolymerizing a polymerized monomer using a well-known polymerization method such as suspension polymerization. The polymerized monomer may be, for example, a styrene monomer such as styrene or an acrylic monomer such as acrylic acid, alkyl (C1-C4) acrylate, or alkyl (C1-C4) meta acrylate. The polymerized toner is formed as particles substantially spherical in shape and having a diameter of about 6-10 μm in order to have excellent fluidity. The toner is compounded with a coloring agent such as carbon black or wax, as well as an additive such as silica to improve fluidity.

The agitator 36 described above is disposed inside the toner accommodating chamber 40. The agitator 36 is formed of ABS or another synthetic resin having flexibility that is integrally molded of a shaft 51, a blade member 52 provided on the shaft 51, a flexible film member 53 disposed on the blade member 52, and a wiper support part 54 provided on the shaft 51. The agitator 36 is provided so as to be capable of rotating only clockwise in FIG. 2 within the toner accommodating chamber 40.

The shaft 51 is disposed in the center of the toner accommodating chamber 40 when viewed from the side and extends in the widthwise direction of the casing 35 spanning between the side walls 46 and 47. The shaft 51 is a flexible rod-shaped member having a diameter of 3-8 mm and is formed longer than the distance between the side walls 46 and 47. One end of the shaft 51 on the side wall 46 side penetrates the side wall 46, protruding outside of the toner accommodating chamber 40. The shaft 51 is rotatably supported in the side wall 46. The other end of the shaft 51 on the side wall 47 side is rotatably supported on the side wall 47 inside the toner accommodating chamber 40.

The blade member 52 is provided on the shaft 51 so as to span the entire width of the agitator 36 inside the toner accommodating chamber 40 without contacting the side walls 46 and 47.

The flexible film member 53 is a film formed of a synthetic resin such as polyethylene terephthalate and is bonded to the blade member 52 across the entire length thereof. The flexible film member 53 is set at a length that forces the flexible film member 53 to contact the bottom wall 43 and bend in order to agitate the toner in the toner accommodating chamber 40.

The wiper support part 54 is provided on both axial ends of the shaft 51 so as to protrude in a direction opposite that in which the blade member 52 protrudes. A wiper member 55 is fixed to each wiper support part 54 by screws and functions to wipe toner detection windows 56 described next. The wiper members 55 elastically contact the side walls 46 and 47 in order to wipe the toner detection windows 56.

Figure 4:
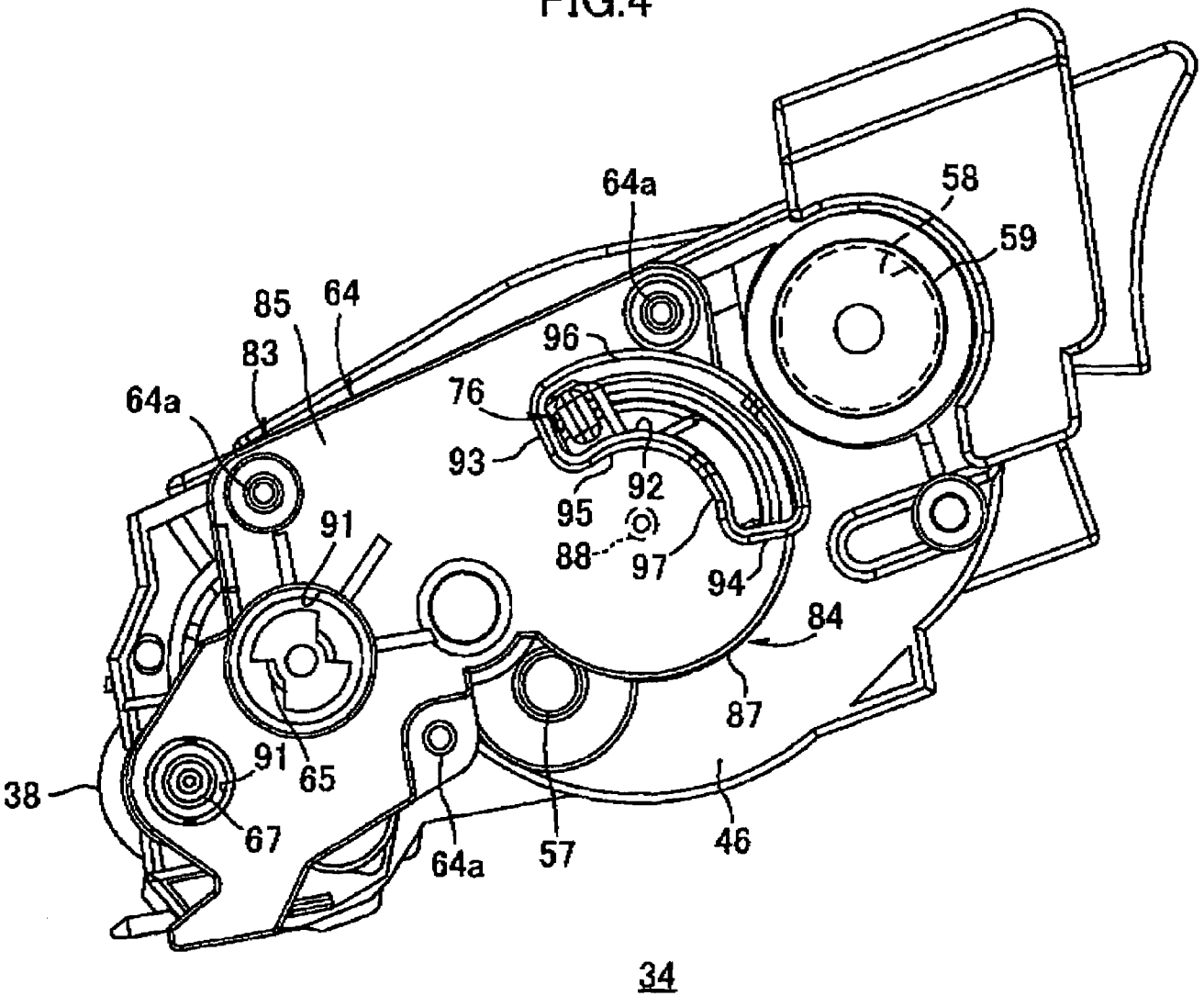
FIG. 4 is a side view showing a developing cartridge used in the laser printer shown in FIG. 1, wherein a detection gear is in a new product position.

The toner detection windows 56 are provided one in each of the side walls 46 and 47 near the bottom rear of the toner accommodating chamber 40 so as to oppose one another across the toner accommodating chamber 40. A cylindrical light transmission part 57 is provided in each of the toner detection windows 56 in the outer surface of the side walls 46 and 47, as shown in FIG. 4.

A toner sensor 165 (see FIG. 13) is provided on the main body of the laser printer 1. The toner sensor 165 includes a light-emitting unit and a light-receiving unit (not shown). Light emitted from the light-emitting unit passes through the light transmission part 57, and the toner sensor 165 determines whether toner exists in the toner accommodating chamber 40 based on whether this light can be received by the light-receiving unit. More specifically, the control unit 150 in the laser printer 1 determines that toner does not exist when the light-receiving unit of the toner sensor 165 detects light from the light-emitting unit.

A toner filling hole 58 is provided in the side wall 46 of the toner accommodating chamber 40 and has a circular shape that penetrates the thickness of the side wall 46. A cap 59 covers the toner filling hole 58 while toner is accommodated in the toner accommodating chamber 40.

As shown in FIG. 2, the supply roller 37, developing roller 38, and thickness regulating blade 39 are disposed in the developing chamber 41.

The supply roller 37 is disposed rearward of the toner accommodating chamber 40, extending in the widthwise direction of the casing 35, and is rotatably supported on the side walls 46 and 47. The supply roller 37 is capable of rotating in a direction opposite the rotational direction of the agitator 36. The supply roller 37 includes a metal roller shaft covered by an electrically conductive urethane sponge.

The developing roller 38 is disposed rearward of the supply roller 37, extending in the widthwise direction of the casing 35, and is rotatably supported on the side walls 46 and 47. A portion of the developing roller 38 is exposed through the opening formed in the rear side of the casing 35. The developing roller 38 is capable of rotating in the same direction as the supply roller 37.

The developing roller 38 includes a metal roller shaft, the surface of which is coated with an electrically conductive resilient material such as an electrically conductive urethane rubber or silicon rubber containing fine carbon particles. The surface of the resilient material is further coated with a urethane rubber or silicon rubber containing fluorine. A power source (not shown) is connected to the roller shaft of the developing roller 38 and applies a developing bias to the shaft during a developing operation.

The supply roller 37 and developing roller 38 are disposed in confrontation with each other. The supply roller 37 contacts the developing roller 38 with sufficient pressure so as to compress to a certain degree. The surfaces of the supply roller 37 and developing roller 38 move in opposite directions in the area of contact between the two rollers.

The thickness regulating blade 39 is supported on the blade support wall 45 above the supply roller 37 and contacts the developing roller 38 at a position between the supply roller 37 and the photosensitive drum 99 with respect to the surface of the developing roller 38.

The thickness regulating blade 39 is disposed in opposition to the developing roller 38 along the widthwise direction thereof. The thickness regulating blade 39 includes a leaf spring member 61 supported on the blade support wall 45 and a contact part 62 provided on the free end of the leaf spring member 61. The contact part 62 is formed of an insulating silicon rubber for contacting the developing roller 38. The contact part 62 is pressed against the surface of the developing roller 38 by the elastic force of the leaf spring member 61.

Figure 5:
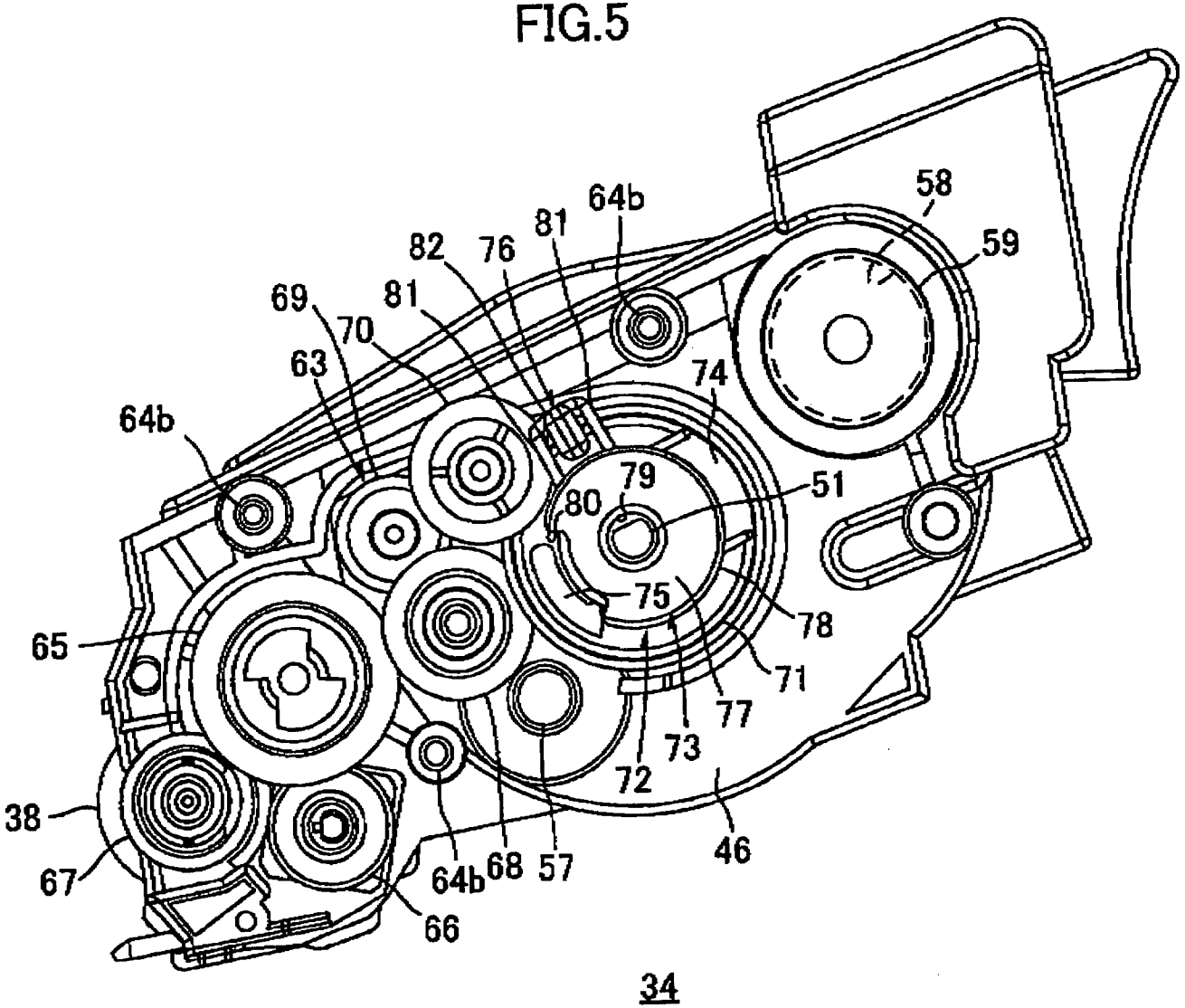
FIG. 5 is a side view showing the developing cartridge of FIG. 4 with no cover member.

The developing cartridge 34 includes a gear mechanism 63 for driving the agitator 36, supply roller 37, and developing roller 38 to rotate, as shown in FIG. 5; and a cover member 64 for covering the gear mechanism 63, as shown in FIG. 4.

As shown in FIG. 5, the gear mechanism 63 is provided on the outer side of the side wall 46. The gear mechanism 63 includes an input gear 65, a supply roller drive gear 66, a developer roller drive gear 67, a first intermediate gear 68, a second intermediate gear 69, a third intermediate gear 70, an agitator drive gear 71, and a sensor gear 72.

The input gear 65 is rotatably disposed between the developing roller 38 and agitator 36 on the outer side of the side wall 46. A motive power is inputted into the input gear 65 from a motor (not shown).

The supply roller drive gear 66 is disposed below the input gear 65 on the end of a roller shaft for the supply roller 37 so as to be engaged with the input gear 65. The developer roller drive gear 67 is disposed rearward of the input gear 65 on the end of a roller shaft for the developing roller 38 so as to be engaged with the input gear 65.

The first intermediate gear 68 is rotatably provided on the outer side of the side wall 46 in front of the input gear 65 and is engaged with the same. The first intermediate gear 68 is a two-stage gear integrally and coaxially formed with outer teeth that engage with the input gear 65 and inner teeth (not shown in the drawing) that engage with the second intermediate gear 69.

The second intermediate gear 69 is rotatably provided on the outer side of the side wall 46 above the first intermediate gear 68 and engaged with the same.

The third intermediate gear 70 is rotatably provided on the outer side of the side wall 46 in front of the second intermediate gear 69 and engaged with the inner teeth of the second intermediate gear 69 (described later). The third intermediate gear 70 is a two-stage gear integrally and coaxially formed with outer teeth that engage with the sensor gear 72 described later and inner teeth (not shown in the drawing) that engage with the second intermediate gear 69.

The agitator drive gear 71 is provided diagonally in front of and below the third intermediate gear 70 on the end of the shaft 51 that penetrates and protrudes outside of the side wall 46. The agitator drive gear 71 is engaged with the inner teeth of the third intermediate gear 70.

The sensor gear 72 is provided on the end of the shaft 51 outside of the agitator drive gear 71 in the axial direction of the agitator 36 so as to overlap the agitator drive gear 71 in the widthwise direction. The sensor gear 72 rotates as a unit with the shaft 51 of the agitator 36.

The sensor gear 72 includes a main sensor gear part 73, a guide member 74, a toothless part 75, and a contact member 76, all formed integrally.

The main sensor gear part 73 is integrally formed of a side plate part 77 substantially circular in a side view, and a cylindrical part 78 substantially cylindrical in shape that bends from a peripheral edge of the side plate part 77 toward the agitator drive gear 71.

A circular hole 79 penetrates the center portion of the side plate part 77 in the thickness direction thereof. An end of the shaft 51 for the agitator 36 penetrates the circular hole 79, and the side plate part 77 is fixed to the end of the shaft 51 via the circular hole 79. This construction enables the sensor gear 72 to rotate together with the shaft 51 of the agitator 36. A support shaft 88 described later of the cover member 64 is fitted into the circular hole 79.

A notched part 80 is formed in the cylindrical part 78 by cutting out a portion of the cylindrical part 78 on the edge in the circumferential direction.

The guide member 74 is provided on the cylindrical part 78 on the opposite side of the circular hole 79 from the notched part 80. The guide member 74 is arc-shaped in a side view and has substantially the same width as the width of the notched part 80. The guide member 74 is formed on the cylindrical part 78 so as to expand radially outward from the side plate part 77.

The toothless part 75 has one end connected to an end of the cylindrical part 78 in the notched part 80 and forms an arc shape from this end toward the other end in the circumferential direction of the cylindrical part 78. The toothless part 75 has a sufficient length to engage with the third intermediate gear 70 only when the sensor gear 72 is in a power transmission position. The other end of the toothless part 75 is a free end and is not connected to the other end of the cylindrical part 78 in the notched part 80.

The contact member 76 is disposed between the guide member 74 and the toothless part 75 along the periphery of the cylindrical part 78. The contact member 76 includes support parts 81, and a contact part 82 supported on the support parts 81.

The support parts 81 protrude radially outward from the cylindrical part 78.

Figure 6:
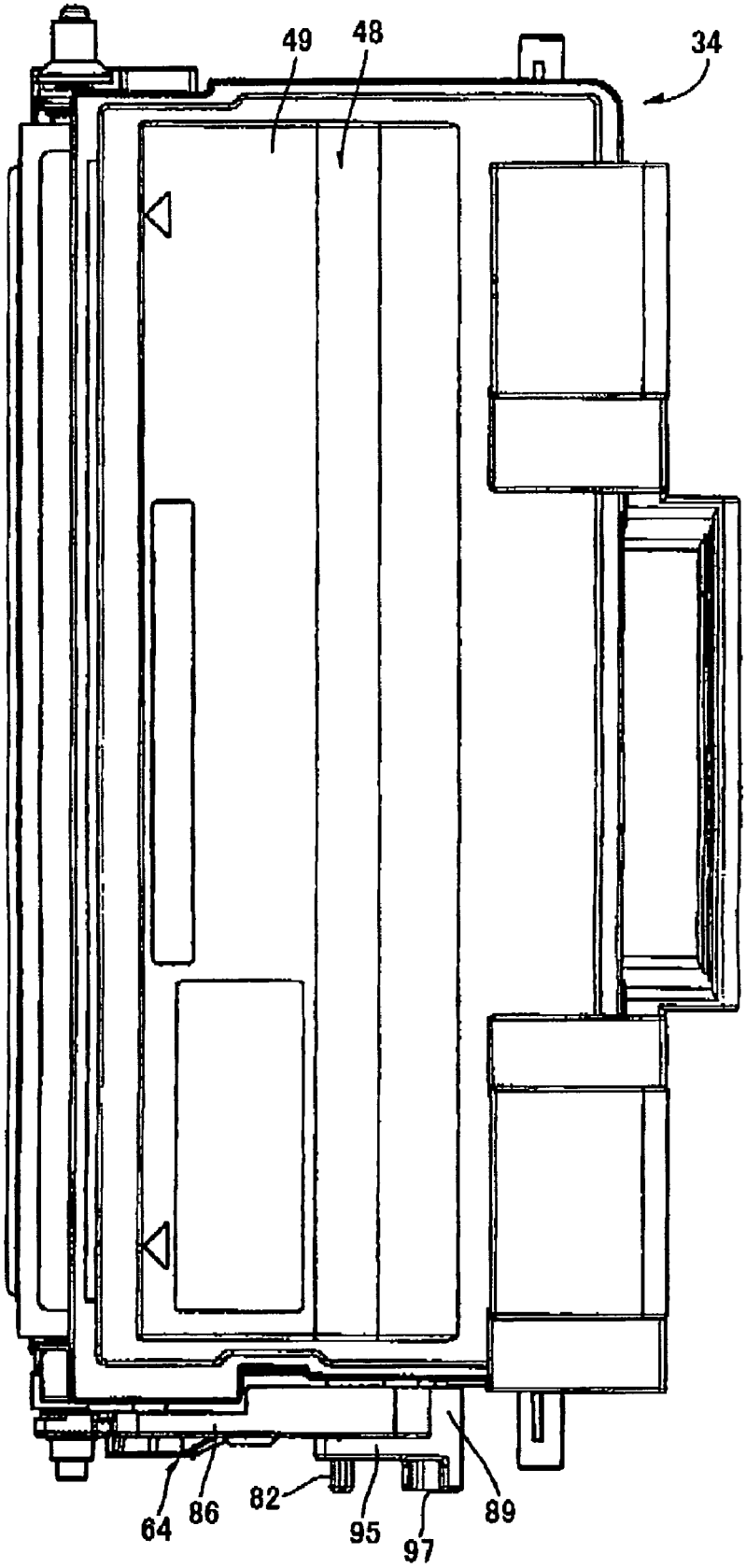
FIG. 6 is a plan view showing the developing cartridge of FIG. 4.

The contact part 82 is substantially rectangular in shape in a plan view (see FIG. 6). One end of the contact part 82 is connected to the free ends of the support parts 81, while the other end extends from the first end toward the outer side of the shaft 51 in the axial direction thereof.

The sensor gear 72 is mounted on an end of the shaft 51 protruding outside the side wall 46 of the developing cartridge 34 so that the toothless part 75 of the sensor gear 72 is in a position not engaged with the third intermediate gear 70 and is in a new product position upstream of the third intermediate gear 70 in the rotational direction of the shaft 51.

As shown in FIG. 4, the cover member 64 is provided on the outer side of the side wall 46 so as to cover the gear mechanism 63. The cover member 64 is integrally provided with a rear cover part 83 for covering the input gear 65, supply roller drive gear 66, developer roller drive gear 67, first intermediate gear 68, second intermediate gear 69, and third intermediate gear 70; and a front cover part 84 for covering the agitator drive gear 71 and sensor gear 72.

The rear cover part 83 is integrally molded of a rear plate part 85 positioned on the outer side of the input gear 65, supply roller drive gear 66, developer roller drive gear 67, first intermediate gear 68, second intermediate gear 69, and third intermediate gear 70; and a rear base part 86 (see FIG. 6) that bends from the peripheral edges of the image-forming unit 5 toward the side wall 46 of the developing cartridge 34. An axle opening 91 is formed in the rear cover part 83, one for each axis of the input gear 65 and the developer roller drive gear 67, so that these axes are exposed in the rear cover part 83.

The front cover part 84 is integrally molded of a disc part 87 that is substantially disc-shaped in a side view and is disposed on the outside of the agitator drive gear 71 and sensor gear 72; and a front base part 89 (see FIG. 6) that bends from the peripheral edge of the disc part 87 toward the side wall 46 of the developing cartridge 34. An arc-shaped opening 92 is formed in the disc part 87 such that a first end 93 is disposed on the upper rear side of the arc-shaped opening 92 and a second end 94 is disposed on the lower front side.

Specifically, the arc-shaped opening 92 exposes the contact part 82 in the disc part 87 and forms an arc-shaped path, when viewed from the side, along which the contact part 82 moves. The arc-shaped opening 92 is formed so that the first end 93 opposes the position of the contact part 82 when the toothless part 75 of the sensor gear 72 is in the new product position and the second end 94 opposes the position of the contact part 82 when the toothless part 75 is in an old product position described later. Within the arc-shaped opening 92 are provided a guide wall 95 running along the periphery of the arc-shaped opening 92, an expanded part 97 formed continuously with the guide wall 95, and a resistance applying part 96.

The guide wall 95 is provided in the disc part 87 covering the inner periphery of the arc-shaped opening 92 and describes a path of motion for the contact part 82. Hence, the guide wall 95 guides the contact part 82 along this path of motion. The guide wall 95 spans from the first end 93 of the arc-shaped opening 92 to the expanded part 97 described next on the second end 94 side and protrudes in the same direction that the contact part 82 protrudes so that the contact part 82 is exposed a prescribed length on the outside of the disc part 87 (the length from the disc part 87 to the free end of the contact part 82 exposed outside of the disc part 87; see FIG. 6). The expanded part 97 is provided on the guide wall 95 on the second end 94 of the arc-shaped opening 92.

The expanded part 97 is substantially U-shaped in a side view and is formed on the guide wall 95 on the second end 94 of the arc-shaped opening 92. As shown in FIG. 6, the expanded part 97 is formed of a length substantially equivalent to the length of the contact part 82 exposed a prescribed length outside of the disc part 87.

As shown in FIG. 4, the resistance applying part 96 is formed on the upper peripheral edge of the arc-shaped opening 92 and expands slightly into the arc-shaped opening 92 from a position near the first end 93 of the arc-shaped opening 92 to a position near the second end 94. The resistance applying part 96 regulates the width of the arc-shaped opening 92 so as to apply resistance to the contact part 82 when the contact part 82 moves.

The support shaft 88 mentioned earlier is provided on the inner wall of the disc part 87 opposing the side wall 46 and at the center of the disc part 87 for supporting the sensor gear 72. The support shaft 88 is fitted into the circular hole 79 of the sensor gear 72 so that the sensor gear 72 is rotatably supported on the support shaft 88.

The front base part 89 bends from the peripheral edge of the disc part 87 toward the side wall 46 of the developing cartridge 34 for covering the agitator drive gear 71 and sensor gear 72 (see FIG. 6). The front base part 89 functions to guide the guide member 74 of the sensor gear 72 when the sensor gear 72 rotates together with the shaft 51 of the agitator 36, and also to protect the toothless part 75 of the sensor gear 72.

Screw holes 64*a* are formed in the cover member 64 in an upper rear part, an upper front side, and a lower central part. Screw holes 64*b* are provided in the side wall 46 of the developing cartridge 34 at locations corresponding to the screw holes 64*a*.

With this construction, the axes of the input gear 65 and developer roller drive gear 67 are fitted into the respective axle openings 91 in the cover member 64. The support shaft 88 of the cover member 64 is fitted into the circular hole 79 formed in the side plate part 77 of the main sensor gear part 73. Further, the contact part 82 of the sensor gear 72 is exposed in the arc-shaped opening 92 of the cover member 64. In this state, the cover member 64 is attached to the side wall 46 side of the developing cartridge 34 by inserting screws into the side wall 46 via the screw holes 64*a* and screw holes 64*b*.

When the cover member 64 is mounted in this way, the contact part 82 is exposed through the first end 93 of the arc-shaped opening 92.

As shown in FIG. 2, the drum cartridge 33 includes a drum frame 98, the photosensitive drum 99 disposed inside the drum frame 98, a Scorotron charger 100, the transfer roller 101, and a cleaning unit 102.

As shown in FIG. 3, the drum frame 98 is configured of a drum accommodating unit 103 on the rear side of the drum frame 98 for accommodating the photosensitive drum 99, Scorotron charger 100, transfer roller 101, and cleaning unit 102; and a process accommodating unit 104 on the front side of the drum frame 98 having an open top and capable of detachably accommodating the developing cartridge 34. The drum frame 98 also has a side wall 105 formed of an introducing part 106 for introducing each axis of the input gear 65 and developer roller drive gear 67, and a receiving part 107 provided forward of the introducing part 106.

The introducing part 106 is a cutout portion that is arc-shaped in a side view and extends in a curved line from the top end to the lower rear side of the side wall 105.

The receiving part 107 is a cutout portion formed as a depression in the top edge of the side wall 105. The receiving part 107 is positioned to correspond to the arc-shaped opening 92 in the developing cartridge 34 when the developing cartridge 34 is mounted in the drum cartridge 33 and is large enough to receive the expanded part 97 and the contact part 82.

As shown in FIG. 2, the photosensitive drum 99 is disposed on the rear side and in opposition to the developing roller 38. The photosensitive drum 99 extends in the widthwise direction of the drum frame 98 and is rotatably supported in the drum frame 98 by both widthwise ends. The photosensitive drum 99 includes an aluminum cylinder, the surface of which has been coated with a positive charging photosensitive layer formed of polycarbonate or the like. The cylindrical tube is electrically grounded.

The Scorotron charger 100 is disposed above the photosensitive drum 99 and opposing but separated a prescribed distance from the same. The Scorotron charger 100 extends in the widthwise direction of the drum frame 98. The Scorotron charger 100 is a positive charging Scorotron type charger that produces a corona discharge from a discharge wire 100*b* (see FIG. 14) formed of tungsten in order to form a uniform charge of positive polarity over the surface of the photosensitive drum 99. The Scorotron charger 100 also includes a grid electrode 100*a* (see FIG. 14). The potential of the grid electrode 100*a* is controlled in order to control the amount of charge that the discharge wire 100*b* forms on the surface of the photosensitive drum 99.

The transfer roller 101 is disposed below the photosensitive drum 99 and in opposition to the same. The transfer roller 101 extends in the widthwise direction of the drum frame 98 and is rotatably supported on the drum frame 98 at both widthwise ends. The transfer roller 101 includes a metal roller shaft that is covered with an electrically conductive rubber material. A power source (not shown) is connected to the roller shaft to apply a transfer bias to the shaft when transferring toner onto the sheet 3.

The cleaning unit 102 is provided in the rear section of the drum accommodating unit 103 on the opposite side of the photosensitive drum 99 from the developing roller 38. The cleaning unit 102 includes a primary cleaning roller 108, a secondary cleaning roller 109, a scraping sponge 110, and a paper dust accumulating unit 111.

The primary cleaning roller 108 is disposed in opposition to the photosensitive drum 99. The primary cleaning roller 108 extends in the widthwise direction of the drum frame 98 and is rotatably supported in the drum frame 98 at both widthwise ends. A cleaning bias is applied to the primary cleaning roller 108 during a cleaning operation.

The secondary cleaning roller 109 is disposed in opposition to the primary cleaning roller 108. The secondary cleaning roller 109 extends in the widthwise direction of the drum frame 98 and is rotatably supported in the drum frame 98 at both widthwise ends.

The scraping sponge 110 is disposed above the secondary cleaning roller 109 and opposes the secondary cleaning roller 109 so as to contact the same. The scraping sponge 110 extends in the widthwise direction of the drum frame 98 and is rotatably supported in the drum frame 98 at both widthwise ends.

The paper dust accumulating unit 111 is a space formed in the drum accommodating unit 103 to the rear side of the primary cleaning roller 108.

With the laser printer 1 of this construction, the developing cartridge 34 is first mounted on the drum cartridge 33. More specifically, the developing cartridge 34 is mounted from above the drum cartridge 33 into the process accommodating unit 104 of the drum frame 98. At this time, the axes of the input gear 65 and developer roller drive gear 67 that protrude from axle openings 91 in the cover member 64 are introduced from the upper side of the introducing part 106 into the deepest area of the introducing part 106. Further, the receiving part 107 formed in the drum frame 98 receives the expanded part 97 provided on the second end 94 of the arc-shaped opening 92. Assembly of the process cartridge 21 is complete when the developing cartridge 34 is mounted on the drum cartridge 33 in this way.

Next, the front cover 32 is pivoted to the open position, exposing the opening 31, and the process cartridge 21 is inserted into the cartridge-accommodating unit 30 of the main frame 2 via the opening 31.

The main frame 2 is also provided with a new/old determining unit 112 (see FIG. 7) for determining whether the developing cartridge 34 is new or old when the process cartridge 21 is mounted in the cartridge-accommodating unit 30.

Figure 7:
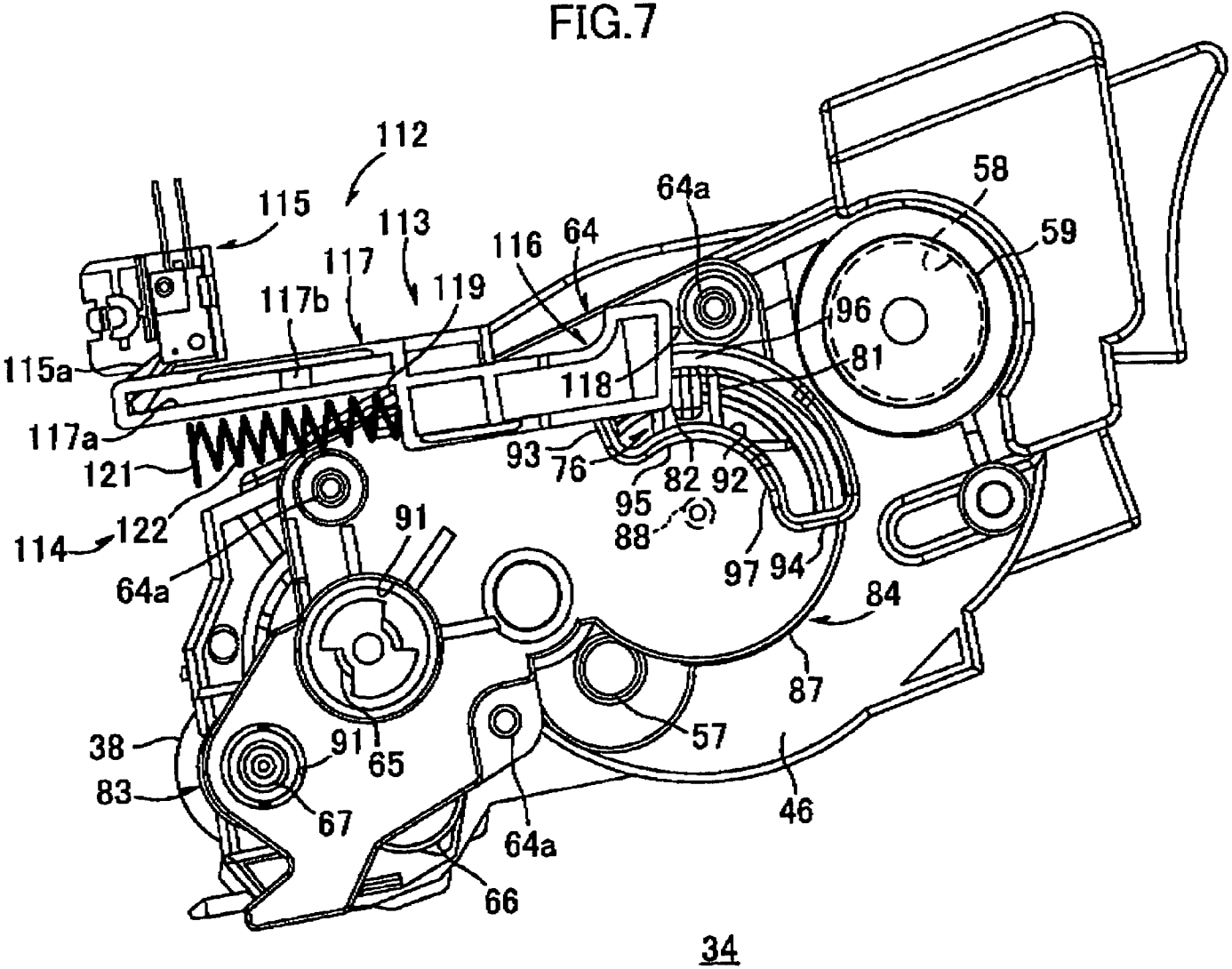
FIG. 7 is a side view showing the developing cartridge, wherein the detection gear is in a power transmission position.

The new/old determining unit 112 is provided in the cartridge-accommodating unit 30 on one side wall of the main frame 2. As shown in FIG. 7, the new/old determining unit 112 includes an actuator 113, a spring unit 114, and a new product sensor 115.

The actuator 113 is rod-shaped and formed integrally of a pressing part 116 on the front end, and a guide part 117 disposed rearward of the pressing part 116.

The pressing part 116 is substantially rectangular in shape in a side view and has a contact surface 118 on the front end, and a pressing surface 119 on the rear end.

The guide part 117 has a slender rod shape that extends rearward from the upper rear end of the pressing part 116. A guide groove 117*a* extending in the front-to-rear direction is formed in the guide part 117.

A guide protrusion 117*b* is formed on the main frame 2 for fitting into the guide groove 117*a*. By fitting the guide protrusion 117*b* into the guide groove 117*a*, the actuator 113 is mounted on the main frame 2 and is capable of sliding in the front and rear directions.

The spring unit 114 includes a fixing plate 121 that is fixed to the main frame 2, and a spring 122. One end of the spring 122 is fixed to the fixing plate 121, while the other end contacts the pressing surface 119 of the pressing part 116. The spring 122 constantly urges the actuator 113 forward toward a first position.

The new product sensor 115 is disposed above the rear end of the guide part 117. The new product sensor 115 includes a sensing lever 115*a* that is capable of pivoting forward and rearward. The sensing lever 115*a* is engaged with the guide groove 117*a* of the guide part 117 and moves forward or rearward along the movement of the actuator 113. With the new product sensor 115 having this structure, it is possible to detect that the developing cartridge 34 is an old product when the sensing lever 115*a* is pivoted forward and that the developing cartridge 34 is a new product when the sensing lever 115*a* is pivoted rearward.

Figure 8:
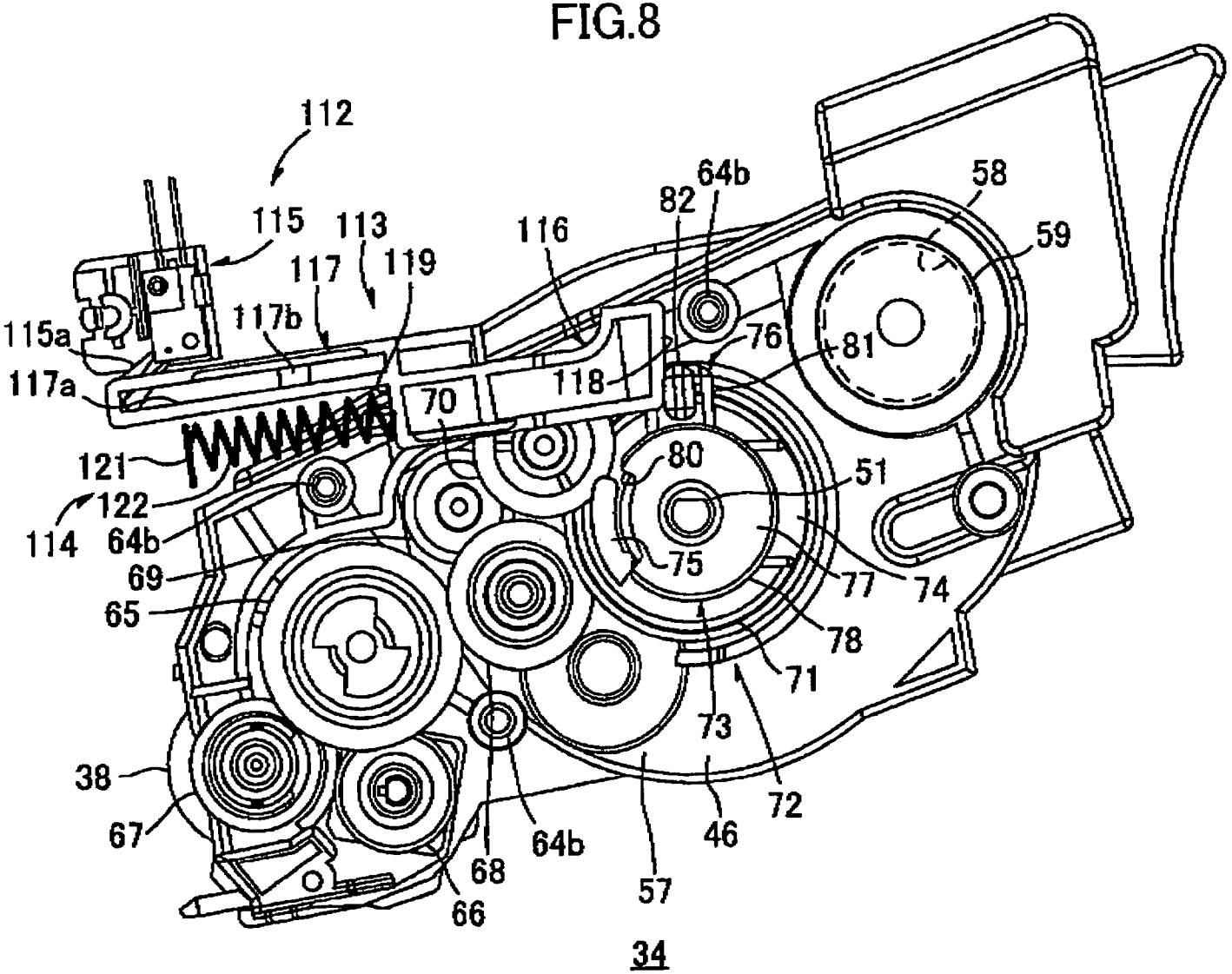
FIG. 8 is a side view showing the developing cartridge of FIG. 7 with no cover member.

When the process cartridge 21 is mounted in the cartridge-accommodating unit 30 of the main frame 2, the contact part 82 of the sensor gear 72 contacts the contact surface 118 of the actuator 113 with pressure. As a result, the contact part 82 moves slightly from the first end 93 of the arc-shaped opening 92 toward the second end 94 in a direction opposite the direction that the developing cartridge 34 is mounted (toward the front of the main frame 2). As shown in FIG. 8, the toothless part 75 of the sensor gear 72 is moved from the new product position where the toothless part 75 is not engaged with the third intermediate gear 70 to the power transmission position in which the toothless part 75 is engaged with the third intermediate gear 70.

Also at this time, the actuator 113 resists the urging force of the spring 122 due to the reaction force from contact with the contact part 82 and moves rearward into a second position. The sensing lever 115*a* of the new product sensor 115 pivots rearward along with the rearward movement of the actuator 113. Hence, the developing cartridge 34 is detected as a new product.

When the process cartridge 21 is first mounted in the cartridge-accommodating unit 30, the laser printer 1 of the present invention initiates a warming-up operation during which the agitator 36 is driven to rotate.

Figure 10:
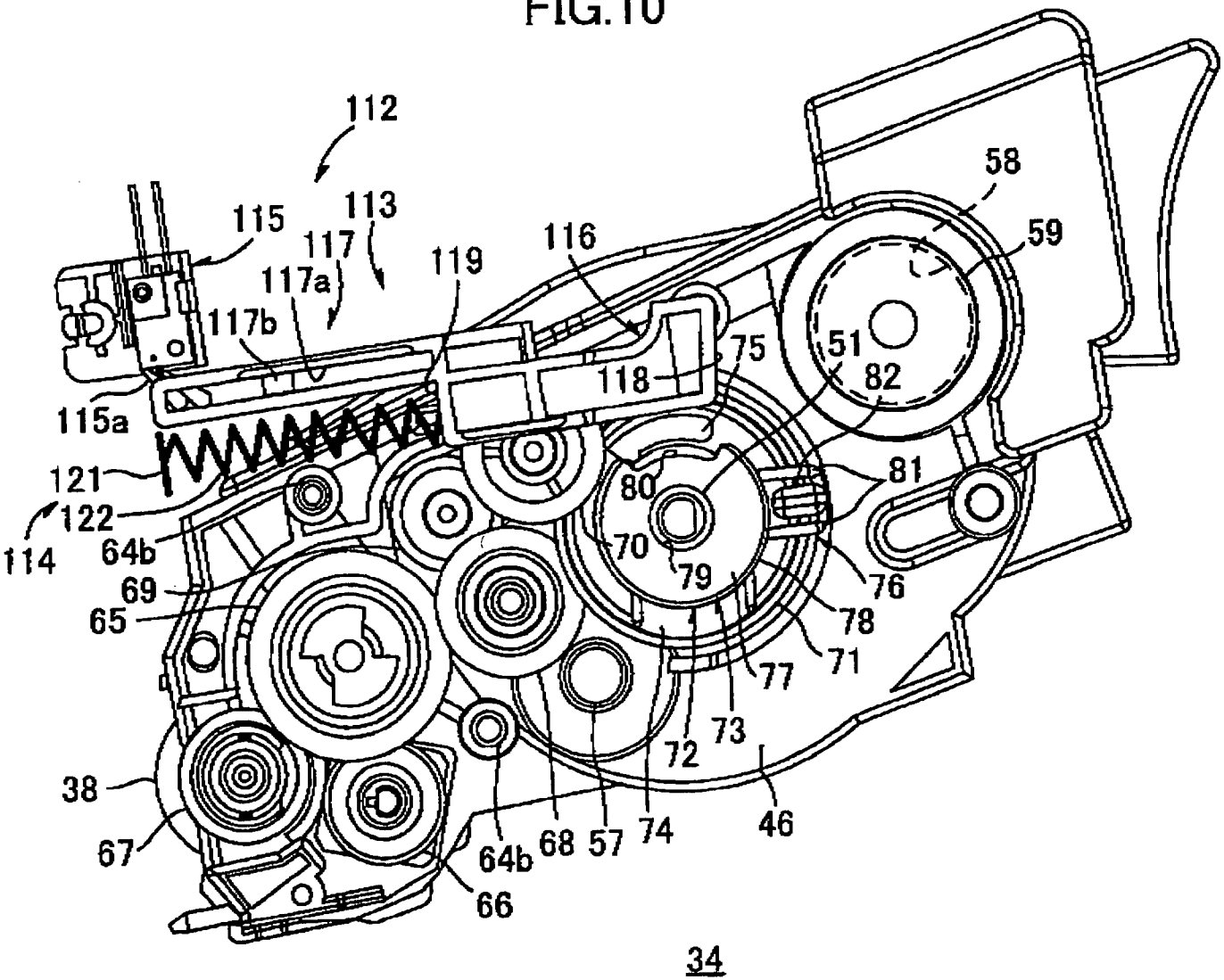
FIG. 10 is a side view showing the developing cartridge of FIG. 9 with no cover member.

At this time, a motive force is simultaneously transferred from the input gear 65 via the first intermediate gear 68, second intermediate gear 69, and third intermediate gear 70 to both the agitator drive gear 71 and the sensor gear 72 engaged with the third intermediate gear 70 in the power transmission position. The sensor gear 72 rotates along with the rotation of the shaft 51 in the agitator 36 and returns from the power transmission position to the old product position, shown in FIG. 10, in which the sensor gear 72 is not engaged with the third intermediate gear 70.

Figure 9:
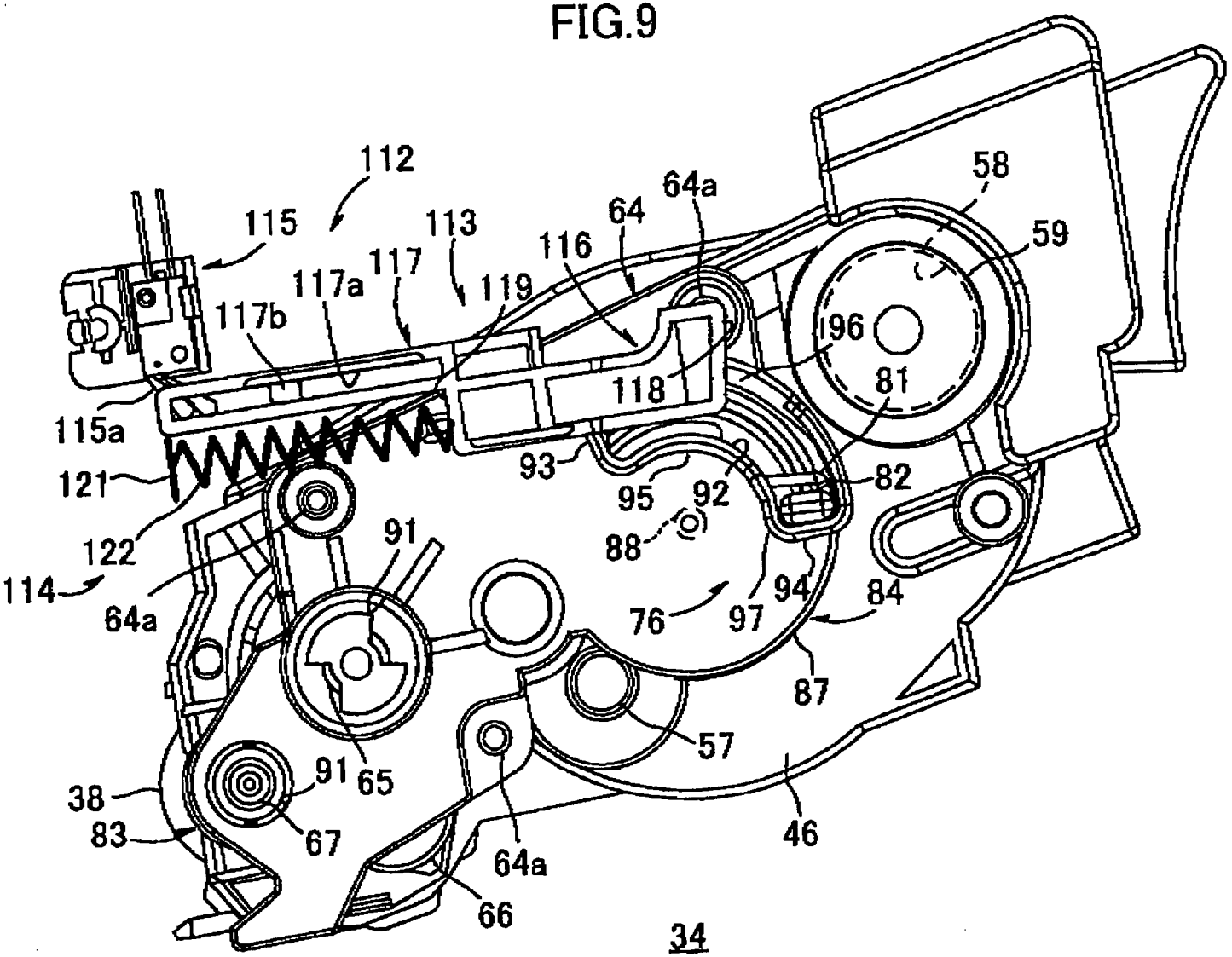
FIG. 9 is a side view showing the developing cartridge contained in a process unit, wherein the detection gear is in an old product position.

Also at this time, the contact part 82, which had previously moved from the first end 93 of the arc-shaped opening 92 to a position slightly toward the second end 94, shown in FIG. 7, now moves to the second end 94 of the arc-shaped opening 92, as shown in FIG. 9, while incurring resistance from the resistance applying part 96. When the contact part 82 moves to the second end 94 of the arc-shaped opening 92, the expanded part 97 formed at the same length as the contact part 82 encompasses the periphery of the contact part 82.

As the contact part 82 moves to this position, the urging force of the spring 122 moves the actuator 113 forward so as to return to the first position. Accordingly, the sensing lever 115*a* of the new product sensor 115 pivots forward as the actuator 113 moves forward. Hence, the developing cartridge 34 is detected as an old product.

Since the agitator 36 can only rotate clockwise, once the sensor gear 72 rotates to the old product position, the sensor gear 72 cannot rotate back to the new product position thereafter. In other words, the sensor gear 72 is irreversibly rotated from the new product position to the old product position. Once positioned in the old product position, the sensor gear 72 slides with respect to the shaft 51, allowing the shaft 51 to be driven to rotate.

After the warming-up operation is completed, normal printing operations can be executed. As the agitator 36 rotates, the flexible film members 53 scrape up toner accommodated in the toner accommodating chamber 40 and convey the toner to the developing chamber 41.

The toner conveyed into the developing chamber 41 is then supplied onto the developing roller 38 by the rotating supply roller 37. When the supply roller 37 supplies toner to the developing roller 38, the toner is positively tribocharged between the supply roller 37 and developing roller 38.

As the developing roller 38 rotates, the charged toner carried on the surface of the developing roller 38 passes between the contact part 62 of the thickness regulating blade 39 and the developing roller 38. The toner is further charged while passing between the contact part 62 and the developing roller 38 and is regulated to a uniform thickness on the surface of the developing roller 38.

As the photosensitive drum 99 rotates in the drum cartridge 33, the Scorotron charger 100 applies a uniform positive charge to the surface of the photosensitive drum 99. The scanning unit 20 produces a laser beam that is irradiated on the charged surface of the photosensitive drum 99 according to image data, forming an electrostatic latent image thereon.

As the developing roller 38 rotates, the positively charged toner carried on the surface of the developing roller 38 comes into contact with the photosensitive drum 99. At this time, toner is selectively supplied to the electrostatic latent image formed on the surface of the photosensitive drum 99, that is, areas of the photosensitive drum 99 that were exposed to the laser beam and therefore have a lower potential then the nonexposed areas, thereby developing the latent image into a visible image.

As the photosensitive drum 99 continues to rotate, the surface of the photosensitive drum 99 carrying the visible image contacts the sheet 3 conveyed from the registration rollers 11 as the sheet 3 passes between the photosensitive drum 99 and the transfer roller 101. During this time, the toner image carried on the surface of the photosensitive drum 99 is transferred to the sheet 3, and the sheet 3 carrying the toner image is conveyed toward the fixing unit 22.

Toner remaining on the photosensitive drum 99 after the image has been transferred to the sheet 3 is collected in the cleaning unit 102. More specifically, when toner is transferred to the sheet 3, a low bias is applied to the primary cleaning roller 108 in the cleaning unit 102. As a result, toner remaining on the photosensitive drum 99 after the transfer is temporarily collected on the primary cleaning roller 108.

When toner is not being transferred to the sheet 3, that is, in intervals between sheets 3 conveyed consecutively, a high bias is applied to the primary cleaning roller 108 so that the toner temporarily collected on the primary cleaning roller 108 is returned to the photosensitive drum 99 and paper dust deposited on the photosensitive drum 99 from the sheet 3 during the transfer operation is collected on the primary cleaning roller 108. The developing roller 38 collects toner that has been returned to the photosensitive drum 99. The secondary cleaning roller 109 captures paper dust from the primary cleaning roller 108 when the paper dust opposes the secondary cleaning roller 109. As the secondary cleaning roller 109 rotates in opposition to the scraping sponge 110, the paper dust captured on the secondary cleaning roller 109 is scraped off by the scraping sponge 110 and collected in the paper dust accumulating unit 111.

The fixing unit 22 is disposed to the rear side of the process cartridge 21 and downstream of the process cartridge 21 in the paper conveying direction. The fixing unit 22 includes a heating roller 123, a pressure roller 124, and a conveying roller 125. The heating roller 123 is configured of a metal tube that accommodates a halogen lamp as a heater. The pressure roller 124 is disposed below the heating roller 123 and contacts the bottom of the heating roller 123 with pressure. The conveying roller 125 is provided downstream of the heating roller 123 and pressure roller 124 in the paper conveying direction.

After toner is transferred onto the sheet 3, the heating roller 123 melts and fixes the toner to the sheet 3 with heat as the sheet 3 passes between the heating roller 123 and pressure roller 124. Subsequently, the conveying roller 125 guides the sheet 3 along a guide plate 126 extending vertically to the rear side of the conveying roller 125 and conveys the sheet 3 toward discharge rollers 127.

When the sheet 3 is conveyed to the discharge rollers 127, the discharge rollers 127 discharge the sheet 3 onto the discharge tray 128.

Next, the sensing unit 140 will be described with reference to FIG. 11. FIG. 11 includes explanatory views illustrating the operation of the sensing unit 140.

Figure 11A:
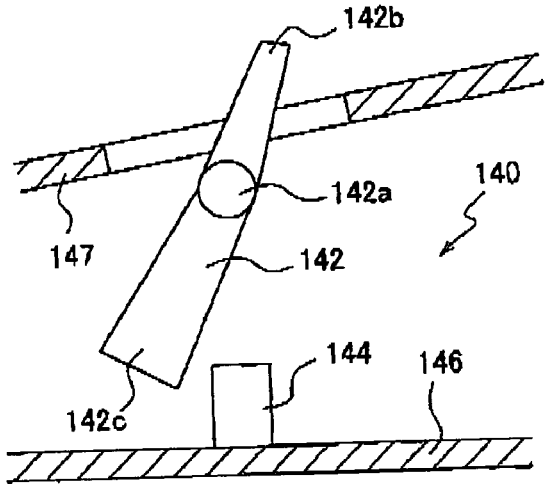
FIGS. 11A through 11C are explanatory diagrams showing operations of a sensing unit.

As shown in FIG. 11A, the sensing unit 140 includes the lever 142, and an optical sensor 144. The optical sensor 144 is a sensor well known in the art that includes a light-emitting unit and a light-receiving unit. The optical sensor 144 is fixed to a sensor base plate 146. The optical sensor 144 is in an ON state when the light-receiving unit detects light emitted from the light-emitting unit (the optical sensor 144 cannot detect the lever 142) and in an OFF state when a rear end 142*c* of the lever 142 blocks the optical path from the light-emitting unit to the light-receiving unit so that the light-receiving unit cannot detect light emitted from the light-emitting unit (the optical sensor 144 cannot detect the lever 142).

The lever 142 is capable of rotating about a rotational shaft 142*a*. A front end 142*b* of the lever 142 protrudes farther upward than a guide member 147 that regulates the moving direction of the sheet 3, that is, to a position intersecting the paper conveying path.

When the process cartridge 21 is not mounted in the main frame 2, the lever 142 is positioned as shown in FIG. 11A. Specifically, the front end 142*b* of the lever 142 is positioned upstream of the rotational shaft 142*a* in the paper conveying direction, and the rear end 142*c* is in a position that cannot be detected by the optical sensor 144.

Figure 11B:
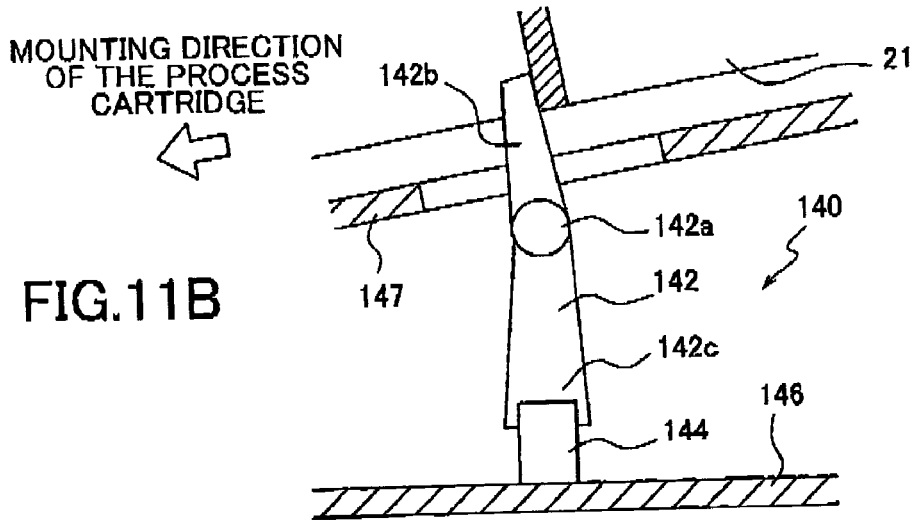
Figure 11C:
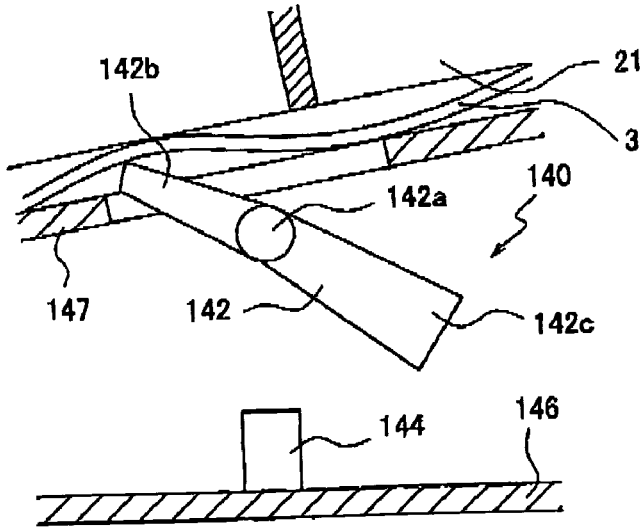

When the process cartridge 21 is mounted in the main frame 2, the front end 142*b* of the lever 142 contacts a part of the process cartridge 21, causing the lever 142 to be displaced to the position shown in FIG. 11B. More specifically, the process cartridge 21 moving in the mounting direction pushes the front end 142*b* of the lever 142, displacing the rear end 142*c* to a position that can be detected by the optical sensor 144, that is, a position between the light-emitting unit and the light-receiving unit. At this time, the control unit 150 described later determines that a cartridge of some kind has been mounted in the main frame 2 and identifies the type of the mounted cartridge.

When the sheet 3 is conveyed along the paper conveying path while the lever 142 is in the state shown in FIG. 11B, the leading edge of the sheet 3 contacts the front end 142*b* of the lever 142, displacing the lever 142 to the position shown in FIG. 1C. In other words, the sheet 3 pushes the front end 142*b* of the lever 142 farther in the paper conveying direction so that the rear end 142*c* of the lever 142 moves to a position that cannot be detected by the optical sensor 144.

Figure 12A:
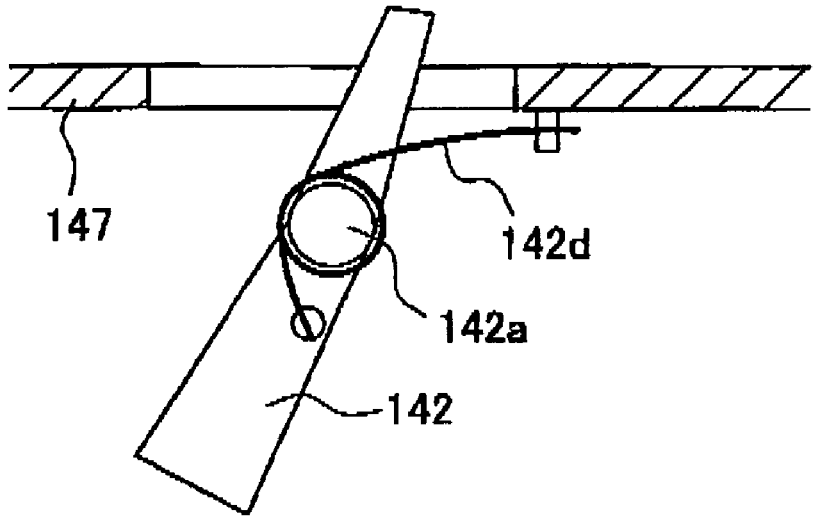
FIG. 12A is an explanatory side view showing the structure of the sensing unit.
Figure 12B:
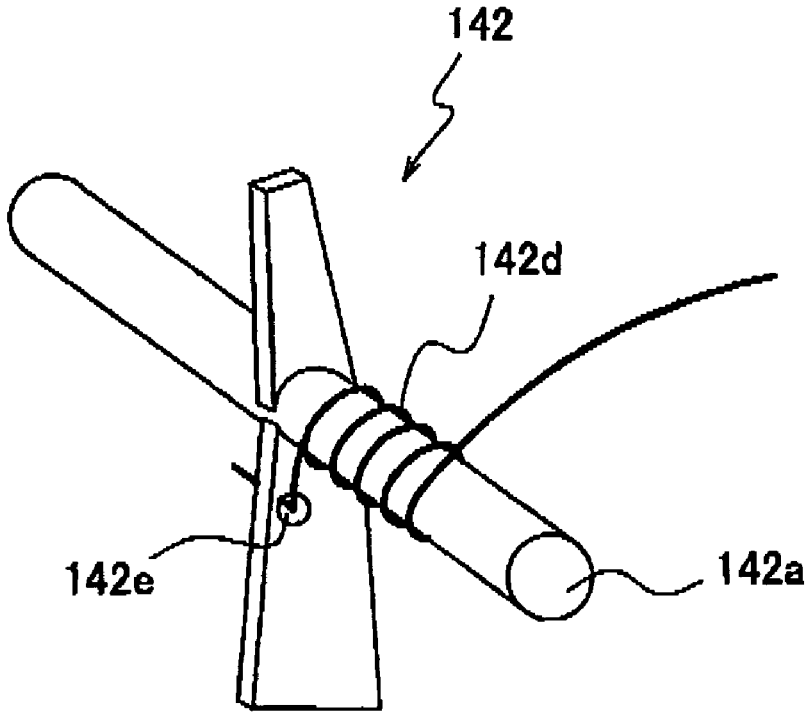
FIG. 12B is an explanatory perspective view showing the structure of the sensing unit.

As described earlier with relation to the position shown in FIG. 11A, a spring 142*d* such as that shown in FIGS. 12A and 12B is provided around the lever 142 for maintaining the lever 142 in this position when the front end 142*b* is not in contact with the process cartridge 21. The spring 142*d* has been omitted from all drawings except for FIGS. 12A and 12B.

The spring is wound around the rotational shaft 142*a* of the lever 142, with one end inserted into a hole 142*e* formed in the lever 142 and the other end fixed to the underside surface of the guide member 147. Hence, the urging force of the spring 142*d* constantly urges the lever 142 back to a fixed position (the position shown in FIG. 11A) so that the lever 142 is maintained in the position shown in FIG. 11A when the process cartridge 21 is not mounted in the main frame 2. When the process cartridge 21 is mounted in the main frame 2, the lever 142 is maintained in the position shown in FIG. 11B, as long as the front end 142*b* is not in contact with the sheet 3.

Since the sensing unit 141 has the same structure as the sensing unit 140, a description of the sensing unit 141 has been omitted. However, the sensing unit 141 is configured to detect only the sheet 3 and not the process cartridge 21 or the like. Hence, while the sensing unit 141 does not detect the sheet 3, the lever 142 in the sensing unit 141 is positioned so that the optical sensor 144 can detect the rear end 142*c* (the state shown in FIG. 11B). Further, while the front end 142*b* is not in contact with the sheet 3, the spring 142*d* in the sensing unit 141 applies an urging force to the lever 142 for returning the rear end 142*c* to a position that can be detected by the optical sensor 144 (the position shown in FIG. 11B).

Figure 13:
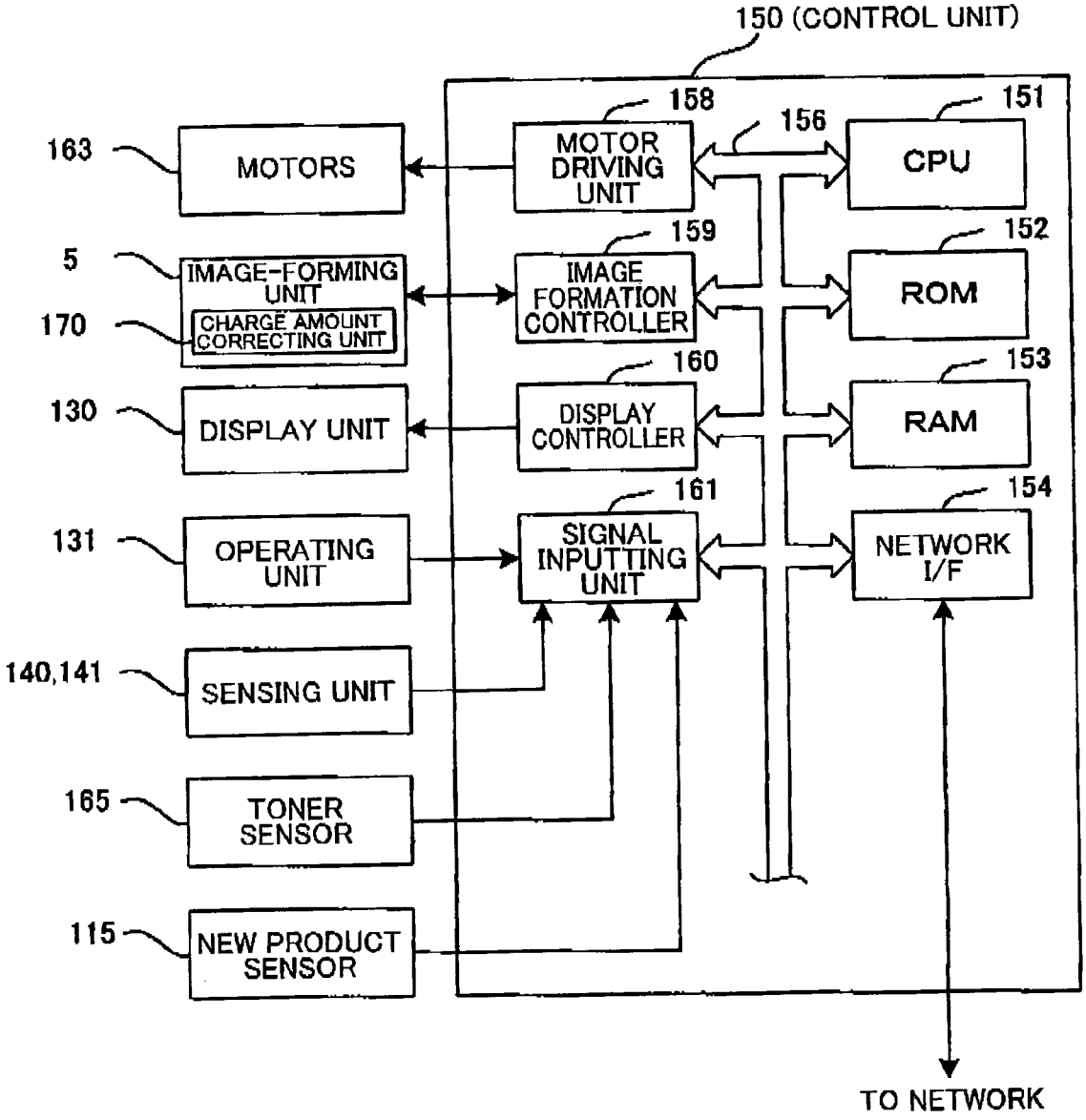
FIG. 13 is a block diagram showing an electrical arrangement of the laser printer.

Next, a control system in the laser printer 1 will be described with reference to FIG. 13. FIG. 13 is a block diagram focusing on the control unit 150 that is built in the laser printer 1 and showing the various electrical connections between the control unit 150 and components positioned around the periphery of the control unit 150.

The control unit 150 is connected to the image-forming unit 5 described earlier, as well as the operating unit 131, the sensing units 140 and 141, various motors 163 including a main motor that drives the paper conveying system of the laser printer 1, and the like. The control unit 150 controls the image-forming unit 5 and the display unit 130 according to commands from the user that are inputted via the operating unit 131 or commands from various data processing devices such as personal computers inputted via a network.

The control unit 150 is configured of a microcomputer well known in the art that includes a CPU 151, a ROM 152, a RAM 153, and a bus line 156 connecting the various components in the control unit 150.

The control unit 150 also includes an image formation controller 159, a motor driving unit 158, a signal inputting unit 161, a display controller 160, the network interface 154 described earlier, and the like.

The image formation controller 159 controls the image-forming unit 5 according to commands received from the CPU 151.

The motor driving unit 158 transmits drive pulses to each of the motors 163 based on commands received from the CPU 151 for driving the motors 163. The signal inputting unit 161 receives command signals from the user inputted via the operating unit 131 and detection signals from the sensing unit 140 and sensing unit 141 into the control unit 150 and converts these signals to signals that can be processed by the CPU 151.

The network interface 154 performs data communications between the control unit 150 and external personal computers or other data processing devices via a network.

Each of the image formation controller 159, motor driving unit 158, display controller 160, signal inputting unit 161, and network interface 154 is connected to the CPU 151, ROM 152, and RAM 153 via the bus line 156.

In the laser printer 1 having this construction, upon receiving a print request from an external data processing device through the network, the CPU 151 controls the driving of the image formation controller 159 and the motors 163 based on subsequent print data transferred across the network (image-forming data) and conveys the sheet 3 while forming an image on the sheet 3 based on the print data.

The CPU 151 transmits the status of the laser printer 1 (the existence of toner, inspection results, and the like) to the external device via the network interface 154.

During image formation, the sensing units 140 and 141 detect the existence of the sheet 3 at each sensor position. The CPU 151 associates drive pulses that the motor driving unit 158 transmits to the motors 163 with detection results by the sensing units 140 and 141. If the sheet 3 does not exist in the expected position, or if the sheet 3 is detected in an incorrect position, the CPU 151 reports a paper jam.

When errors such as paper jams occur or during an inspection process described later (see FIG. 18), the CPU 151 transmits a command to the display controller 160 to display a description of the error or inspection results on the display unit 130.

Upon detecting an error based on detection results from the sensing units 140 and 141, the CPU 151 halts operations of the image-forming unit 5 and executes a process to prohibit an image-forming operation.

The image-forming unit 5 described above is provided with a charge amount correcting unit 170 (see FIG. 13) for controlling the amount of charge that the Scorotron charger 100 applies to the surface of the photosensitive drum 99 and for controlling the transfer bias applied to the transfer roller 101. Based on signals inputted from the charge amount correcting unit 170, the CPU 151 issues commands to the image formation controller 159 to transmit signals for controlling the duty ratio to the charge amount correcting unit 170.

Figure 14:
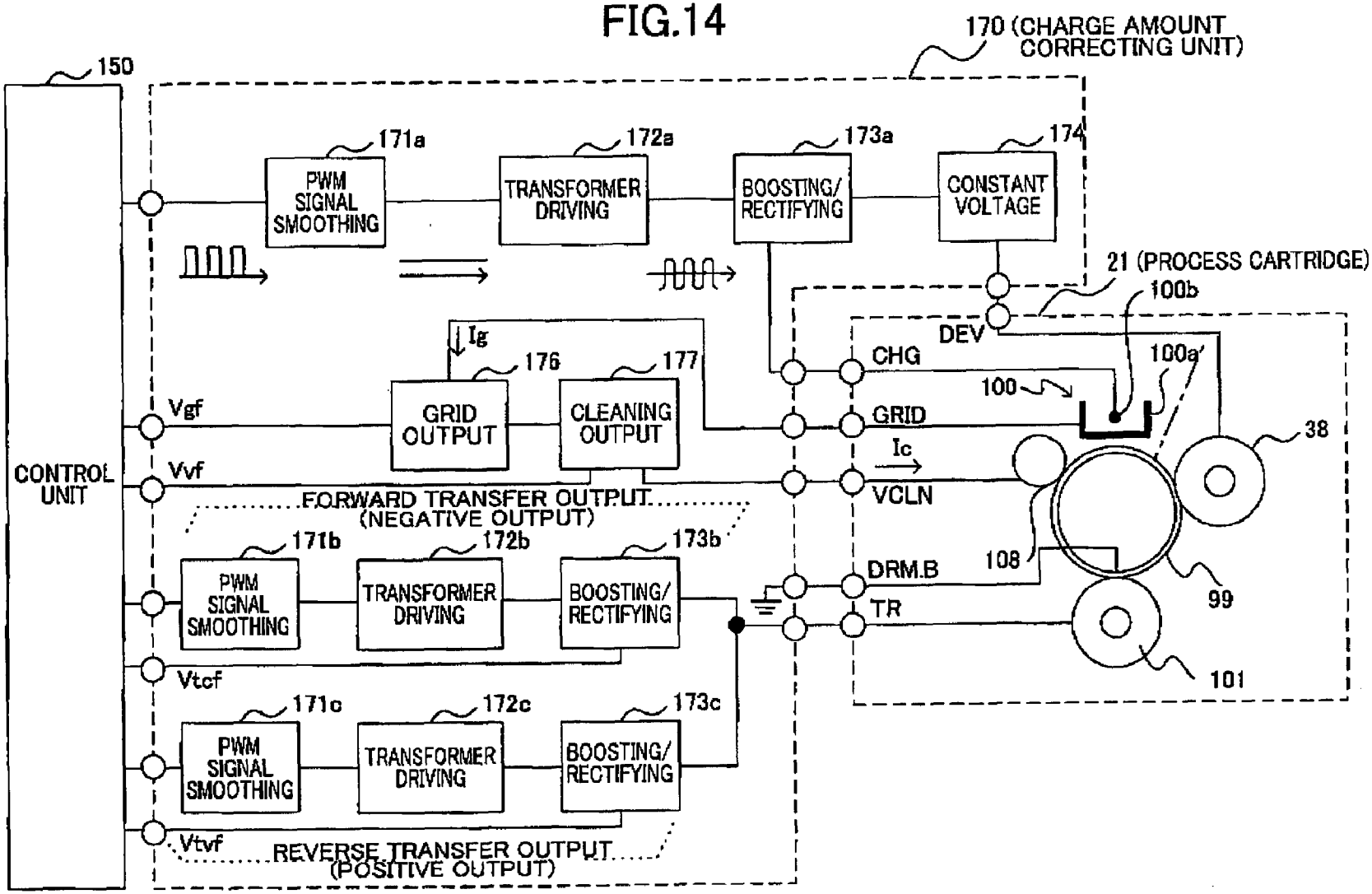
FIG. 14 is a block diagram showing an arrangement of a charge amount correcting unit and also shows an arrangement of a process cartridge.

Next, the charge amount correcting unit 170 will be described in detail with reference to FIG. 14. FIG. 14 is a block diagram illustrating the structure of the charge amount correcting unit 170 and various components peripheral to the charge amount correcting unit 170.

The charge amount correcting unit 170 includes PWM signal smoothing circuits 171*a*-171*c*, transformer driving circuits 172*a*-172*c*, boosting/rectifying circuits 173*a*-173*c*, a constant voltage circuit 174, a grid outputting circuit 176, and a cleaning output circuit 177.

When the process cartridge 21 is mounted at a prescribed position in the laser printer 1, six terminal provided on each of the charge amount correcting unit 170 and the process cartridge 21 are brought into contact with one another to form electrical connections. The six terminals are CHG, GRID, DEV, VCLN, DRM.B, and TR, as shown in FIG. 14.

Next, the components constituting the charge amount correcting unit 170 will be described in greater detail.

Each of the PWM signal smoothing circuits 171*a*-171*c* receives a signal from the control unit 150 with a controlled duty ratio, filters this signal, and outputs a DC signal proportional to the duty ratio of the signal.

Each of the transformer driving circuits 172*a*-172*c* receives a DC signal from the respective PWM signal smoothing circuits 171*a*-171*c* and outputs an alternating current based on the voltage of the DC signal to the boosting/rectifying circuits 173*a*-173*c*.

Each of the boosting/rectifying circuits 173*a*-173*c* receives the alternating current output from the transformer driving circuits 172*a*-172*c*, boosts the voltage of the alternating current, and rectifies and filters the new current to produce a high voltage, such as 7000V. The high voltage produced by the boosting/rectifying circuit 173*a* is supplied to the discharge wire 100*b*, while the high voltages produced by the boosting/rectifying circuit 173*b* and boosting/rectifying circuit 173*c* are applied to the transfer roller 101 as a transfer bias. The PWM signal smoothing circuit 171*b* and PWM signal smoothing circuit 171*c*, transformer driving circuit 172*b* and transformer driving circuit 172*c*, and boosting/rectifying circuit 173*b* and boosting/rectifying circuit 173*c* for applying a voltage to the transfer roller 101 are provided in dedicated circuits (each circuit containing one of each component) in order to produce a forward transfer output (negative output) and a reverse transfer output (positive output).

Part of the high voltage generated by the boosting/rectifying circuit 173*a* and supplied to the discharge wire 100*b* is outputted to the constant voltage circuit 174, while the majority of the voltage is applied as a discharge voltage to the discharge wire 100*b* of the Scorotron charger 100.

The constant voltage circuit 174 is a constant voltage circuit well known in the art. The constant voltage generated by the constant voltage circuit 174 (a voltage higher than the surface potential of the photosensitive drum 99 prior to charging) is applied to the developing roller 38 as a developing bias.

The grid outputting circuit 176 is connected to the grid electrode 100*a*, the cleaning output circuit 177, and the control unit 150. In this way, the grid outputting circuit 176 diverts part of the current flowing to the grid electrode 100*a* to the cleaning output circuit 177 side in order to produce a cleaning output.

The cleaning output circuit 177 is connected to the grid outputting circuit 176 and the primary cleaning roller 108. The cleaning output circuit 177 prevents a current from flowing from the primary cleaning roller 108 to the grid outputting circuit 176.

Hence, the PWM signal smoothing circuits 171*a*-171*c*, transformer driving circuits 172*a*-172*c*, boosting/rectifying circuits 173*a*-173*c*, and constant voltage circuit 174 of the charge amount correcting unit 170 generate biases that are applied to the discharge wire 100*b*, the transfer roller 101, and the developing roller 38. The charge amount correcting unit 170 divides the current discharged from the discharge wire 100*b* that does not flow to the surface of the photosensitive drum 99 (hereinafter, a current Ig flowing through the grid electrode 100*a*) into a current If for producing a voltage returned to the control unit 150, and a current Ic flowing to the primary cleaning roller 108. The control unit 150 controls signals inputted into the 170*a*, which applies a bias to the discharge wire 100*b*, to achieve a constant voltage Vgf that is returned to the control unit 150.

The control unit 150 also controls signals inputted into the PWM signal smoothing circuit 171*b* and PWM signal smoothing circuit 171*c* so that the boosting/rectifying circuit 173*b* and boosting/rectifying circuit 173*c* that apply a bias to the transfer roller 101 output a predetermined constant voltage or constant current.

The cleaning output circuit 177 is configured to transmit a feedback signal Vvf to the control unit 150 corresponding to the voltage value of a cleaning bias outputted from the cleaning output circuit 177.

Similarly, the boosting/rectifying circuit 173*b* and boosting/rectifying circuit 173*c* that apply a bias to the transfer roller 101 are configured to transmit feedback signals Vtvf and Vtcf to the control unit 150 corresponding to voltage values of the transfer biases outputted from the boosting/rectifying circuit 173*b* and boosting/rectifying circuit 173*c*.

These feedback signals (Vgf, Vvf, Vtvf, and Vtcf) are used in an inspection process described later for determining whether the circuits are producing a normal bias.

Figure 15:
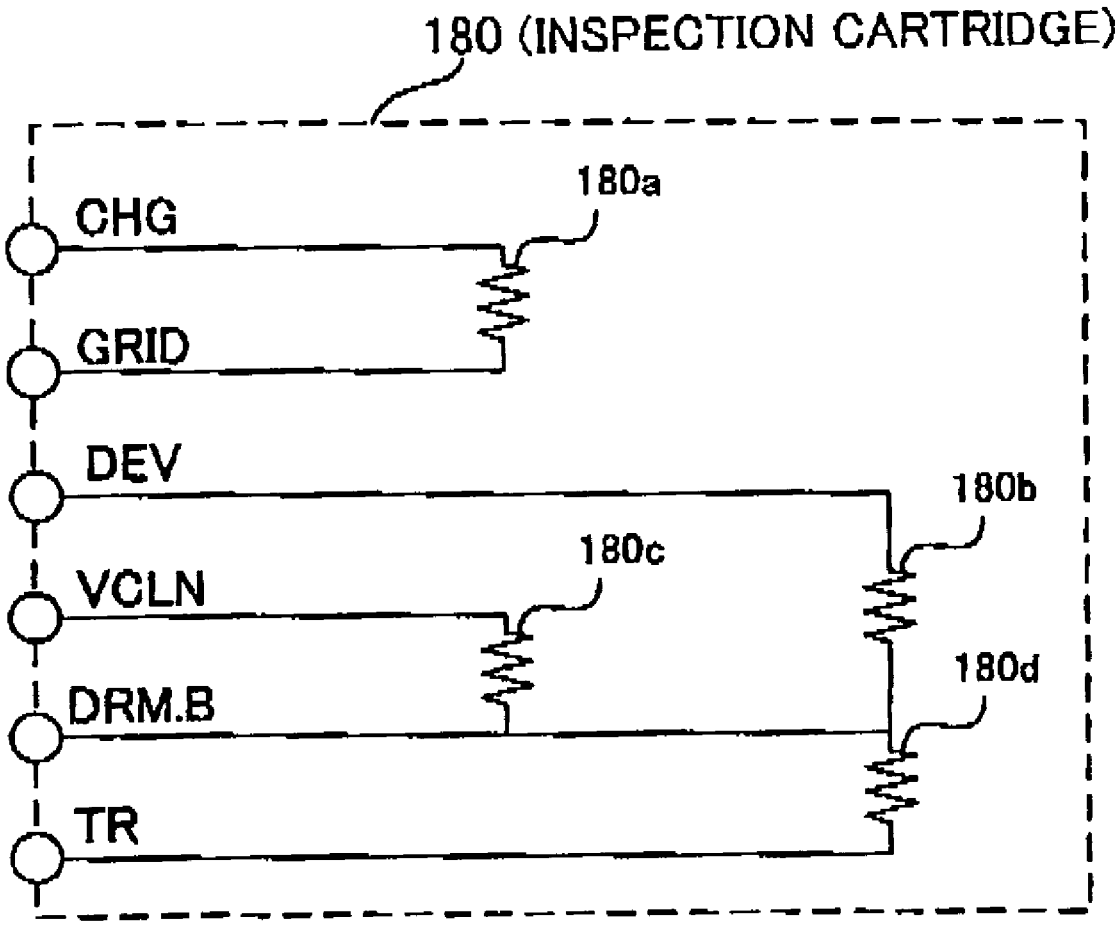
FIG. 15 is an explanatory diagram showing an internal structure of an inspection cartridge.

Next, the inspection cartridge 180 will be described with reference to FIG. 15. FIG. 15 is an explanatory diagram illustrating the internal structure of the inspection cartridge 180. As shown in FIG. 15, the inspection cartridge 180 includes the same number of terminals as the process cartridge 21. However, the internal structure of the inspection cartridge 180 is completely different from that of the process cartridge 21.

Specifically, the inspection cartridge 180 is provided with the resistor 180*a* in place of the Scorotron charger 100 found in the process cartridge 21. Similarly, the inspection cartridge 180 includes the resistors 180*b*-180*d* in place of the photosensitive drum 99, developing roller 38, primary cleaning roller 108, and transfer roller 101.

The resistors 180*a*-180*d* are set so that the resistance values between terminals (such as resistance values for VCLN-DRM.B, DEV-DRM.B, and TR-DRM.B) when the inspection cartridge 180 is mounted in the laser printer 1 are smaller than the resistance values when the process cartridge 21 is mounted in the laser printer 1.

The resistance values are set in this way because a proper output inspection can be performed with any resistance values, provided that the relationships (output characteristics) of load and output (voltage) between the terminals have already been studied and the output inspections are performed while referring to the results of this study.

Figure 16A:
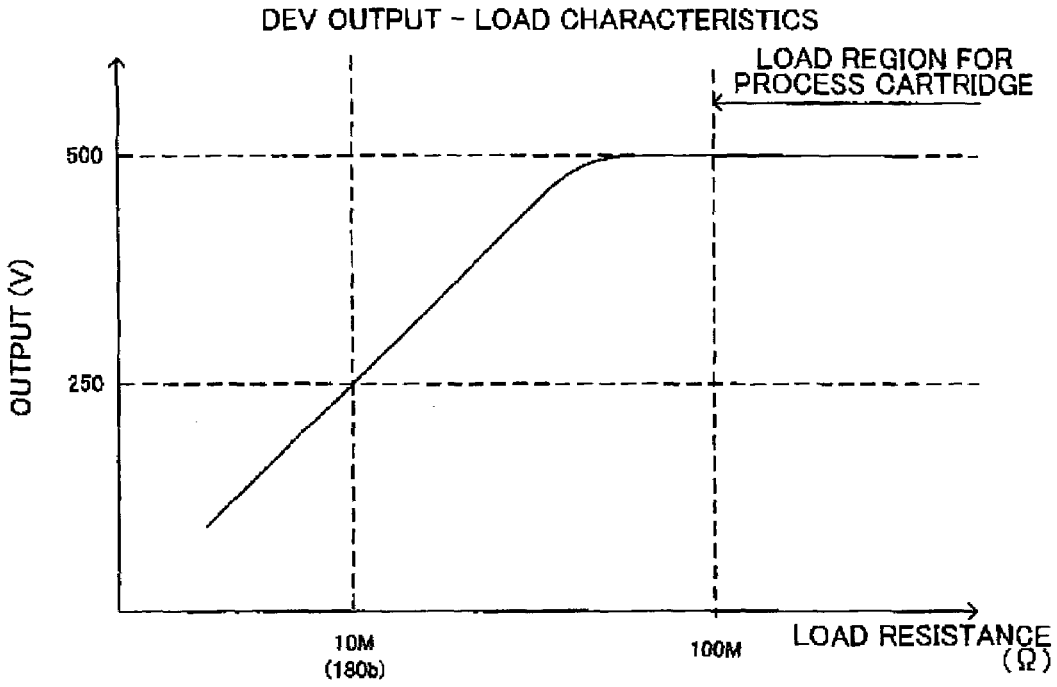
FIG. 16A is a graphical representation illustrating a relationship between a a load resistance across DEV-DRM.B and an output.
Figure 16B:
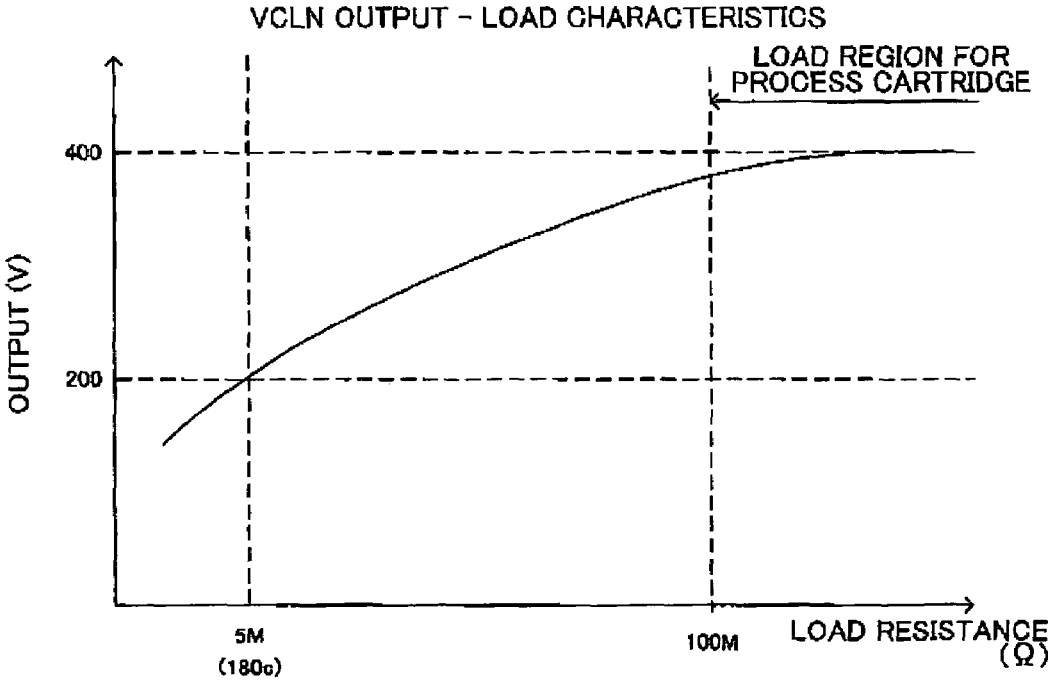
FIG. 16B is a graphical representation illustrating a relationship between a load resistance across VCLN-DRM.B and an output.
Figure 17:
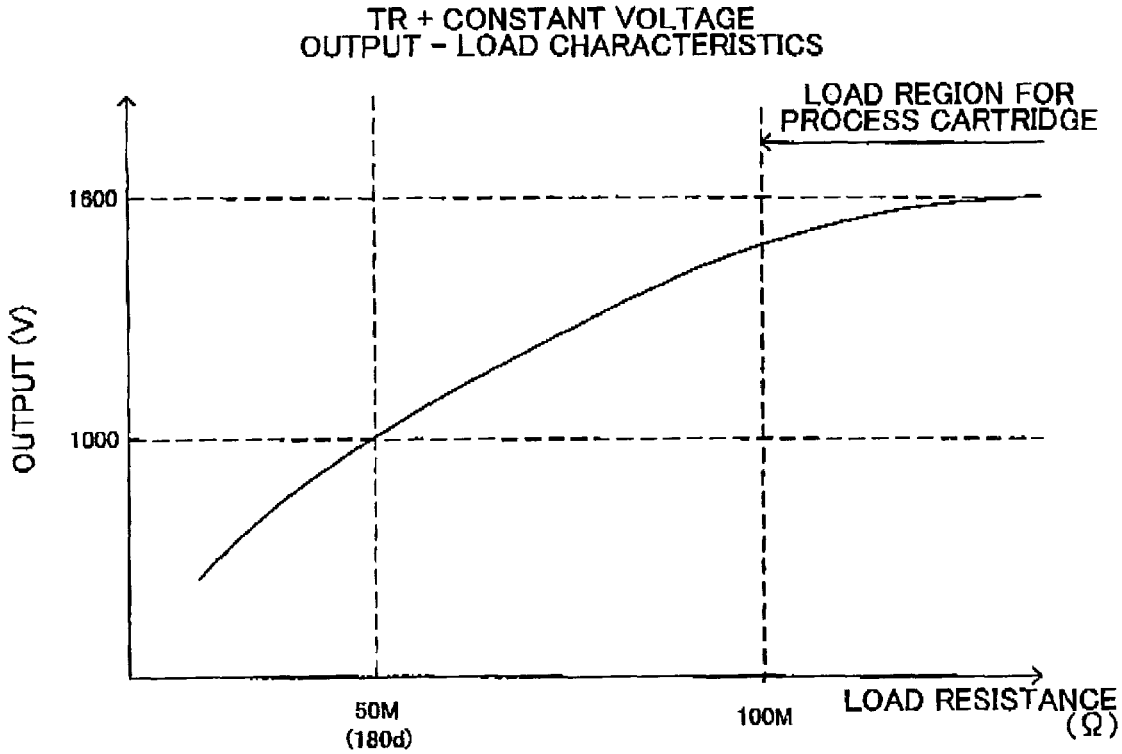
FIG. 17 is a graphical representation illustrating a relationship between a load resistance across TR-DRM.B and an output.

FIGS. 16 and 17 are graphs showing the relationships of output voltage to load resistance between terminals DEV-DRM.B (FIG. 16A), VCLN-DRM.B (FIG. 16B), and TR-DRM.B (FIG. 17). As shown in FIGS. 16 and 17, as the load resistance between terminals increases, the output voltage also increases. However, when the load resistance increases to a certain degree, the output voltage between terminals remains almost constant, even when the load resistance changes.

The resistance values between terminals in the process cartridge 21 are set to produce a region (a load resistance of 100 MΩ or greater) in which the output voltage remains almost constant between terminals, even when the load resistance changes.

In the inspection cartridge 180 shown in FIG. 15, the resistor 180*b* provided between the terminals DEV and DRM.B, for example, is set to 10 MΩ. In this case, as shown in FIG. 16A, it is sufficient to obtain an output of about 150 V (an output smaller than that produced when the process cartridge 21 is mounted in the laser printer 1).

The resistors 180*c* and 180*d* provided between terminals VCLN and DRM.B and TR and DRM.B, respectively, are both set to 50 MΩ.

When performing inspections using the inspection cartridge 180 having this construction, problems that occur during assembly, such as poor contacts or the use of defective electrodes, may prevent any output from being produced or may produce output values equivalent to those when the process cartridge 21 is mounted.

Accordingly, by inputting these output values into the control unit 150 as feedback signals, it is possible to detect assembly problems or abnormalities in the electrodes based on the values of these signals.

As with the process cartridge 21, the inspection cartridge 180 also includes the sensor gear 72 and the light transmission part 57. However, the sensor gear 72 is fixed to the new product position in the inspection cartridge 180.

Therefore, when the inspection cartridge 180 is mounted in the laser printer 1, the toner sensor 165 determines that no toner exists, and the new product sensor 115 determines that the cartridge is a new product.

If the process cartridge 21 were mounted in the laser printer 1, it would be inconceivable for the toner sensor 165 to detect a state of no toner at the same time the new product sensor 115 determines that the cartridge is a new product (indicating that the process cartridge 21 is a new cartridge without any toner). Therefore, when the CPU 151 detects a state of no toner and the new product sensor 115 simultaneously detects a new cartridge, the CPU 151 of the CPU 151 determines that the inspection cartridge 180 is mounted in the laser printer 1. At this time, the CPU 151 switches the operating mode of the laser printer 1 from the image-forming mode used to form images on the sheet 3 to the self-diagnostic mode and initiates the inspection process described later.

When the CPU 151 of the control unit 150 subsequently determines that the process cartridge 21 is mounted in the laser printer 1 (hence, the toner sensor 165 does not detect a state of no toner at the same time the new product sensor 115 detects a new cartridge), the CPU 151 switches the operating mode back to the image-forming mode.

Figure 18:
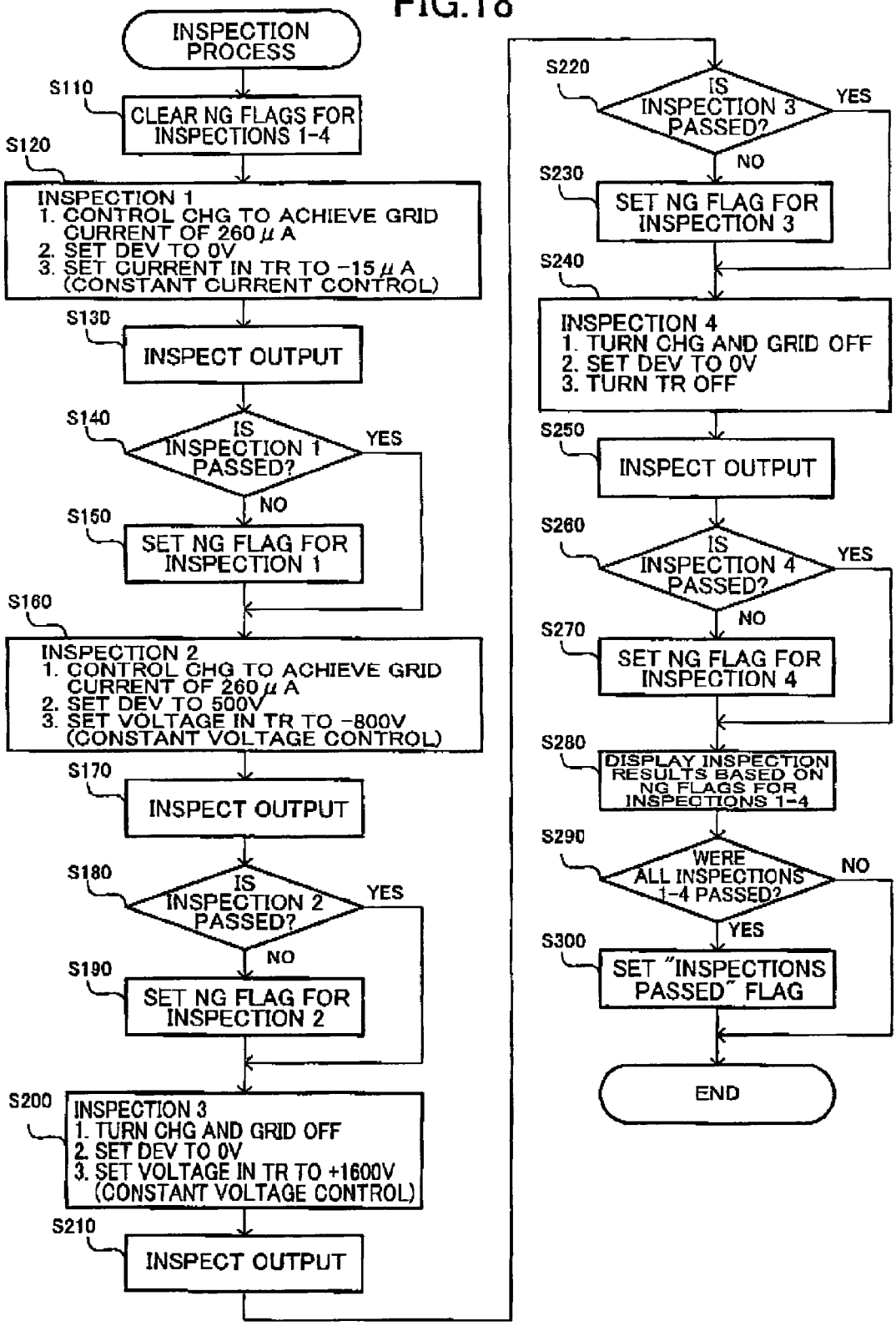
FIG. 18 is a flowchart illustrating an inspection process according to an embodiment of the invention.

Next, the inspection process will be described with reference to the flowchart in FIG. 18. The inspection process is executed by the CPU 151 of the control unit 150 when the inspection cartridge 180 has been mounted in the laser printer 1.

In S110 of the inspection process shown in FIG. 18, the CPU 151 clears four flags stored in the RAM 153 for each of inspections 1-4 that are used to indicate a failed inspection (hereinafter referred to as NG flags). In other words, bits assigned to the NG flags for inspections 1-4 are set to zero in the RAM 153.

In S120 the CPU 151 initiates the output for inspection 1. In inspection 1, the CPU 151 sets terminal DEV to 0 V and performs constant current control to maintain a current of −15 μA flowing from the boosting/rectifying circuit 173*c* to the terminal TR (the current actually flows from the terminal TR to the boosting/rectifying circuit 173*c*), while controlling the voltage applied to the terminal CHG to achieve a current of 260 μA returning from the grid outputting circuit 176 to the control unit 150. Through inspection 1, it is possible to determine whether the laser printer 1 has been assembled properly. It is also possible to determine whether the bias applied to the transfer roller 101 can be controlled with a constant current.

In S130, the CPU 151 determines whether the potential at each terminal is within an allowable range. In S140 the CPU 151 determines whether the results for inspection 1 are normal. If the results for inspection 1 are normal (S140: YES), then the CPU 151 advances to S160. However, if there is an aberration in the results for inspection 1 (S140: NO), then in S150 the CPU 151 sets the NG flag for inspection 1 and advances to S160. Specifically, in S150 the CPU 151 sets a bit in the RAM 153 assigned to the NG flag for inspection 1 to "1".

In S160 the CPU 151 initiates output for an inspection 2. In inspection 2, the CPU 151 sets the terminal DEV to 500 V, and performs constant voltage control for maintaining a voltage of −800 V applied from the boosting/rectifying circuit 173*c* to the terminal TR, while controlling the voltage applied to the terminal CHG to achieve a current of 260 μA returning from the grid outputting circuit 176 to the control unit 150. Through inspection 2, it is possible to determine whether the constant voltage circuit 174 is functioning normally, and whether the forward transfer output for the bias applied to the transfer roller 101 is normal.

In S170 the CPU 151 determines whether the potential at each terminal falls within the allowable range. In S180 the 151 determines whether the results for inspection 2 are normal. If the results for inspection 2 are normal (S180: YES), then the CPU 151 advances to S200. However, if the results for inspection 2 are abnormal (S180: NO), then in S190 the CPU 151 sets the NG flag for inspection 2 and advances to S200.

In S200 the CPU 151 initiates output for inspection 3. In inspection 3, the CPU 151 sets the terminal DEV to 0 V, and performs constant voltage control for maintaining a voltage of +1600 V applied from the boosting/rectifying circuit 173*b* to the terminal TR. In this inspection, a voltage is not applied to the terminal CHG. Through inspection 3, it is possible to determine whether the reverse transfer output for the bias applied to the transfer roller 101 is normal.

In S210 the CPU 151 determines whether the potential at each terminal is within an allowable range. In S220 the CPU 151 determines whether the results for inspection 3 are normal. If the results for inspection 3 are normal (S220: YES), then the CPU 151 advances to S240. However, if there are aberrations in the results for inspection 3 (S220: NO), then in S230 the CPU 151 sets the NG flag for inspection 3 and advances to S240.

In S240 the CPU 151 initiates output for inspection 4. In inspection 4, the CPU 151 sets the terminal DEV to 0 V. In this inspection, no voltage is applied to the terminal TR or the terminal CHG. Through inspection 4, it is possible to determine whether the OFF function of the power source is working properly.

In S250 the CPU 151 determines whether the potential at each terminal is within the tolerable range. In S260 the CPU 151 determines whether the results for inspection 4 are normal. If the results for inspection 4 are normal (S260: YES), then the CPU 151 advances to S280. However, if the results for inspection 4 are abnormal (S260: NO), then in S270 the CPU 151 sets the NG flag for inspection 4 and advances to S280.

In S280 the CPU 151 displays the results of the inspections on the display unit 130 based on the NG flags for inspections 1-4. In S290 the CPU 151 determines whether the laser printer 1 passed all inspections 1-4. If all inspections were passed (S290: YES), then in S300 the CPU 151 sets an "inspections passed" flag, and the inspection process ends. However, if any of the inspections 1-4 were not passed (S290: NO), then the inspection process ends without setting the "inspections passed" flag.

In the inspection process described above, the time interval from the moment each inspection is initiated until the output of the inspections is checked and the time interval from the moment each inspection ends until the next inspection is begun are set to appropriate intervals that do not adversely affect the inspection results.

When the operating mode of the laser printer 1 is in the normal mode, for example, in inspection 2 of the inspection process (S160), an image-forming operation is performed by applying a combination of voltages. Accordingly, inspections 1, 3, and 4 in the inspection process are performed under conditions (voltage, current) not used in the normal mode. These inspections cover a discharge test for inspecting whether electrical discharge is occurring at any of the terminals, a withstand voltage test for determining whether the components can withstand noise or other adverse conditions, and a power off test for determining whether the power source can be reliably turned off.

The laser printer 1 having the construction described above is configured to allow an inspection cartridge 180 to be detachably mounted therein and includes the charge amount correcting unit 170 for driving at least one of the Scorotron charger 100, developing roller 38, transfer roller 101, and the cleaning rollers 108 and 109. The CPU 151 of the control unit 150 switches the operating mode of the laser printer 1 from a normal mode for image-forming operations to a self-diagnostic mode for diagnosing the state of the laser printer 1 based on whether the inspection cartridge 180 is mounted in the laser printer 1. The CPU 151 directs the charge amount correcting unit 170 to drive the target component by outputting drive commands for self-diagnosis to the charge amount correcting unit 170 after switching the operating mode to the self-diagnostic mode. The CPU 151 determines whether the operating status of the charge amount correcting unit 170 is normal based on drive commands received from the drive commanding unit 151.

The laser printer 1 is also configured so that the process cartridge 21 can be detachably mounted therein. When the charge amount correcting unit 170 is provided on the main body of the laser printer 1 and the process cartridge 21 is mounted in the laser printer 1, the charge amount correcting unit 170 is capable of communicating with a device to be driven in the process cartridge 21.

The inspection cartridge 180 can be mounted in the laser printer 1 in place of the process cartridge 21. The laser printer 1 includes the toner sensor 165 and the new product sensor 115 for identifying the type of cartridge mounted therein. The CPU 151 of the control unit 150 selects the self-diagnostic mode for the laser printer 1 when determining that the inspection cartridge 180 is mounted in the laser printer 1 based on detection results from the toner sensor 165 and new product sensor 115 and selects the normal mode when determining that the process cartridge 21 is mounted in the laser printer 1.

Accordingly, the laser printer 1 having this construction can switch the operating mode based on whether the inspection cartridge 180 is mounted in the laser printer 1 and can prevent the operating mode from being switched due to incorrect operations by the user. Further, this construction eliminates tedious external operations or the input of instructions.

In the self-diagnostic mode, the CPU 151 can test the electrical connection at contact points between the process cartridge 21 and the laser printer 1. Further, since the self-diagnostic mode can be implemented when the inspection cartridge 180 is mounted in place of the process cartridge 21, it is possible to perform diagnoses (such as a diagnosis that outputs a higher voltage) that are not possible when the process cartridge 21 is mounted in the laser printer 1.

Further, since the self-diagnostic mode is only selected when the inspection cartridge 180 is mounted in the laser printer 1, the same inspection cartridge 180 can be used in a plurality of image-forming devices for performing inspections at a site for mass producing laser printers.

Further, since the inspection cartridge 180 has resistance values set smaller than the electrical resistances in the devices targeted for driving in the process cartridge 21, larger currents can more easily be used during inspections. Hence, the sensitivity for inspections can be improved when performing conduction tests.

Further, the inspection cartridge 180 has an internal structure different from that of the process cartridge 21. Accordingly, the CPU 151 can identify the type of cartridge mounted in the laser printer 1 using the toner sensor 165 and the new product sensor 115 to detect the internal structure of the cartridge. Hence, when the inspection cartridge 180 is mounted in the laser printer 1, the toner sensor 165 and new product sensor 115 determine that the cartridge is new and that the cartridge does not contain developer, regardless of the intended use for the cartridge.

Since the sensors can detect differences in the internal status for each type of cartridge, the type of cartridge can be determined reliably.

Further, the toner sensor 165 and new product sensor 115 that detect the internal status of the process cartridge 21 are used for identifying the type of the cartridge mounted in the laser printer 1. Accordingly, the laser printer 1 can identify the type of cartridge without requiring a new sensor for identifying the cartridge.

In the laser printer 1 described above, the charge amount correcting unit 170 drives a plurality of target devices. The CPU 151 of the control unit 150 outputs drive commands to the charge amount correcting unit 170 so that the voltages that the charge amount correcting unit 170 outputs to the devices to be driven are a combination and size of voltage not outputted in the normal mode.

More specifically, the drive commanding unit 151 directs the drive applying unit 170 to generate a high voltage that is not outputted when the laser printer 1 is in the normal mode. When the charge amount correcting unit 170 is driving a plurality of target devices, the CPU 151 fixes the output to one of the target devices to a constant potential not used during the normal mode, while directing the charge amount correcting unit 170 to generate outputs for the other target devices.

By outputting and diagnosing voltages that are not used during the normal mode, the laser printer 1 having this construction can perform diagnoses under conditions more suitable to measurements. Therefore, the laser printer 1 can improve the measurement accuracy of the diagnosing unit.

The laser printer 1 described above also includes the display unit 130 for displaying the results of inspections externally. The laser printer 1 also includes the RAM 153 for storing diagnostic results from the inspection process, and the network interface 154 for transmitting the diagnostic results stored in the RAM 153 externally.

Therefore, the laser printer 1 having this construction can notify a user of the diagnostic results without using an external device. By connecting the laser printer 1 to an external device, diagnostic results transmitted to the external device can be viewed thereby, enabling the user to take any number of steps in response to these results. Since large numbers of diagnostic results can be easily accumulated, the laser printer 1 facilitates statistical analysis of such results.

While the invention has been described in detail with reference to specific embodiments thereof, it would be apparent to those skilled in the art that many modifications and variations may be made therein without departing from the spirit of the invention, the scope of which is defined by the attached claims.

For example, in the preferred embodiment described above, the new product sensor 115 detects whether the actuator 113 is in the first position or the second position according to the pressure or release of the contact part 82 on the sensor gear 72. However, an optical sensor may be provided to directly detect the position of the contact part 82 instead. Since the contact part 82 extends outward from the sensor gear 72 in the axial direction of the shaft 51, it would be very easy to detect the position of the contact part 82 directly with an optical sensor.

Further, while the laser printer 1 of the preferred embodiment described above is provided with the primary cleaning roller 108 and secondary cleaning roller 109, the laser printer 1 may also be configured without the primary cleaning roller 108 and secondary cleaning roller 109. Further, a construction having a cleaning brush may also be provided in place of the primary cleaning roller 108 and secondary cleaning roller 109.

The inspection cartridge 180 in the preferred embodiment described above is not provided with one of the target devices to be driven in the process cartridge 21, such as the transfer roller 101 or the developing roller 38, but the inspection cartridge 180 may be provided with one or all of these devices.

In the preferred embodiment described above, the CPU 151 of the control unit 150 displays the diagnostic results on the display unit 130. However, the CPU 151 may also store the diagnostic results from the inspection process on the laser printer 1 so that these results may be acquired later by an external device.

While the present invention is applied to the laser printer 1 in the preferred embodiment described above, the present invention is not limited to a laser printer, but may be applied to any image-forming device capable of forming images on a sheet of paper, a transparency sheet, or another recording medium.

In S280 of the inspection process according to the preferred embodiment, the CPU 151 displays the inspection results (details of failed inspections) on the display unit 130 based on the NG flags for inspections 1-4. However, the CPU 151 may also display locations of abnormalities (abnormality details) in the inspections as the inspection results. In this case, an error flag corresponding to the component constituting the charge amount correcting unit 170 is set when setting the NG flag and the abnormal location is displayed based on this error flag.

Since the laser printer 1 having this configuration can identify locations in which abnormalities occur, repairs and parts replacement are simplified.

Next, a laser printer 1 according to a second embodiment of the present invention will be described. The laser printer 1 according to the second embodiment differs from that according to the first embodiment only in the structure of the inspection cartridge 180 in the process that the CPU 151 of the control unit 150 performs when a cartridge is mounted in the laser printer 1. The remaining structure and operations of the laser printer 1 are identical to that in the first embodiment. Therefore, only areas of the second embodiment that differ from the laser printer 1 according to the first embodiment will be described, wherein like parts and components will be designated with the same reference numerals to avoid duplicating description.

While the laser printer 1 according to the first embodiment identifies the type of cartridge mounted in the laser printer 1 based on detection results by the toner sensor 165 and the new product sensor 115, the laser printer 1 according to the second embodiment identifies the type of cartridge based on detection results from the sensing units 140 and 141.

Figure 19A:
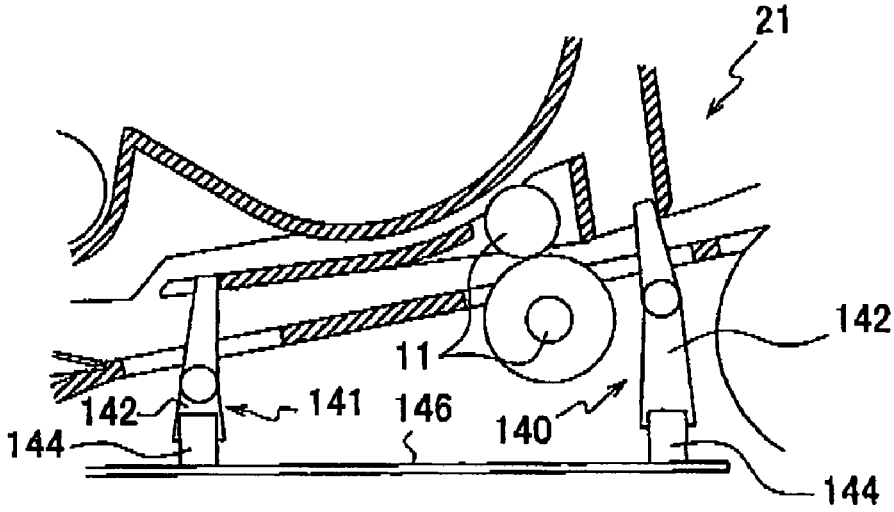
FIG. 19A is a cross-sectional view showing the process cartridge mounted on the laser printer according to the embodiment of the invention.
Figure 19B:
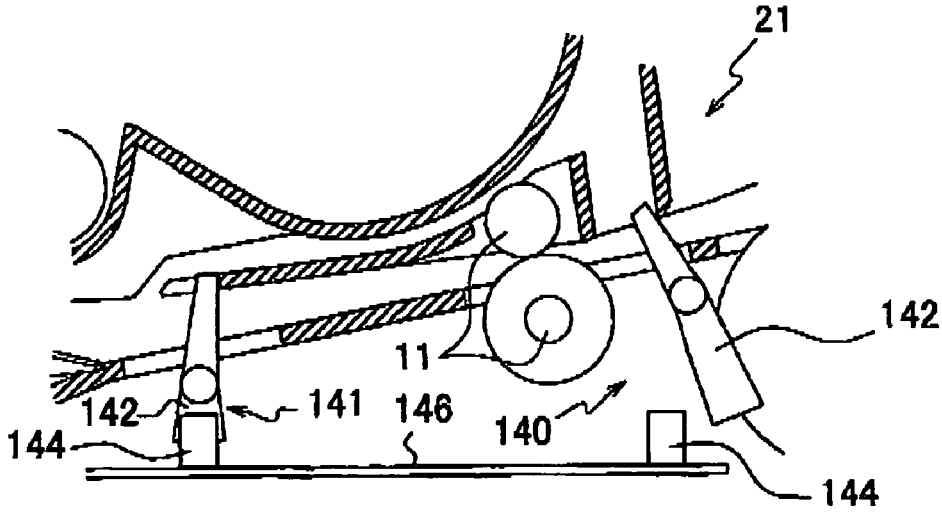
FIG. 19B is a cross-sectional view showing the inspection cartridge mounted on the laser printer according to the embodiment of the invention.

The method for identifying a cartridge mounted in the laser printer 1 according to the second embodiment will be described with reference to FIGS. 19A and 19B. FIGS. 19A and 19B are side cross-sectional views of the laser printer 1 near the sensing units 140 and 141. As in the first embodiment, the lever 142 of the sensing units 140 and 141 in the second embodiment is positioned in a location that cannot be detected by the optical sensor 144 (the position shown in FIG. 11A when a cartridge is not mounted in the laser printer 1).

As shown in FIG. 19A, when the process cartridge 21 is mounted in the laser printer 1, the lever 142 of the sensing units 140 and 141 are contacted by the process cartridge 21 and both moved to positions that can be detected by the optical sensors 144 (the position shown in FIG. 11B). Hence, when the process cartridge 21 is mounted, the CPU 151 of the control unit 150 receives signals from both the sensing units 140 and 141 indicating that the optical sensor 144 has detected the lever 142.

However, when the inspection cartridge 180 is mounted in the laser printer 1, as shown in FIG. 19B, the lever 142 of the sensing unit 141 is moved to a position that can be detected by the corresponding optical sensor 144, just as when the process cartridge 21 was mounted. However, the lever 142 of the sensing unit 140 passes the detectable position and moves to a position that cannot be detected by the optical sensor 144. In other words, the lever 142 of the sensing unit 140 moves to a position indicating that the sheet 3 has been detected (see FIG. 11C).

Therefore, while the inspection cartridge 180 is mounted in this way, the CPU 151 receives a signal from the sensing unit 141 indicating that the optical sensor 144 has detected the lever 142, but does not detect a signal from the sensing unit 140 indicating that the optical sensor 144 has detected the lever 142.

Accordingly, the CPU 151 can identify the type of cartridge mounted in the laser printer 1 based on the detection status of each of the sensing units 140 and 141 when the front cover 32 is closed, for example.

In the laser printer 1 of the second embodiment, a sensor (not shown) is provided for detecting the open and closed status of the front cover 32 and for transmitting the detection results to the control unit 150.

The laser printer 1 of the second embodiment described above includes the sensing unit 140 that changes in detection status when one of the process cartridge 21 and inspection cartridge 180 is mounted in the laser printer 1; and the sensing unit 141 that changes in detection status when at least the other of the process cartridge 21 and the inspection cartridge 180 is mounted in the laser printer 1. The CPU 151 of the control unit 150 identifies the type of cartridge mounted in the laser printer 1 based on the detection results received from the sensing units 140 and 141.

Further, the sensing units 140 and 141 are provided on the conveying path of the sheet 3. Accordingly, the position of the sheet 3 can be detected based on the change in detection status when the sheet 3 passes positions at which the sensing units 140 and 141 are provided. The sensing unit 140 is provided on the upstream side of the sensing unit 141 with respect to the paper conveying direction and is configured to change in detection status when the process cartridge 21 is mounted in the laser printer 1. The CPU 151 of the control unit 150 determines that the inspection cartridge 180 is the type of cartridge mounted in the laser printer 1 when the detection status from the sensing unit 141 changes, but not the detection status from the sensing unit 140.

Hence, by simply modifying the shape of each cartridge according to the type of cartridge, the laser printer 1 described above can determine the type of cartridge using the sensing units 140 and 141. Accordingly, the type of cartridge can be identified according to a simple construction.

Since each cartridge detecting unit is also used as a means for detecting the position of the sheet 3, the position of the sheet 3 can be detected without providing a new means for that purpose.

In the second embodiment, the CPU 151 of the control unit 150 determines that the process cartridge 21 is mounted in the laser printer 1 when both the sensing units 140 and 141 are in an ON state, and determines that the inspection cartridge 180 is mounted when only the sensing unit 141 is in an ON state. However, the present invention is not limited to this configuration.

For example, the laser printer 1 may be configured so that only the sensing unit 140 is set to the ON state when the process cartridge 21 is mounted in the laser printer 1. Therefore, the CPU 151 of the control unit 150 can determine that the process cartridge 21 is mounted in the laser printer 1 when only the sensing unit 140 is in the ON state.

Figure 20A:
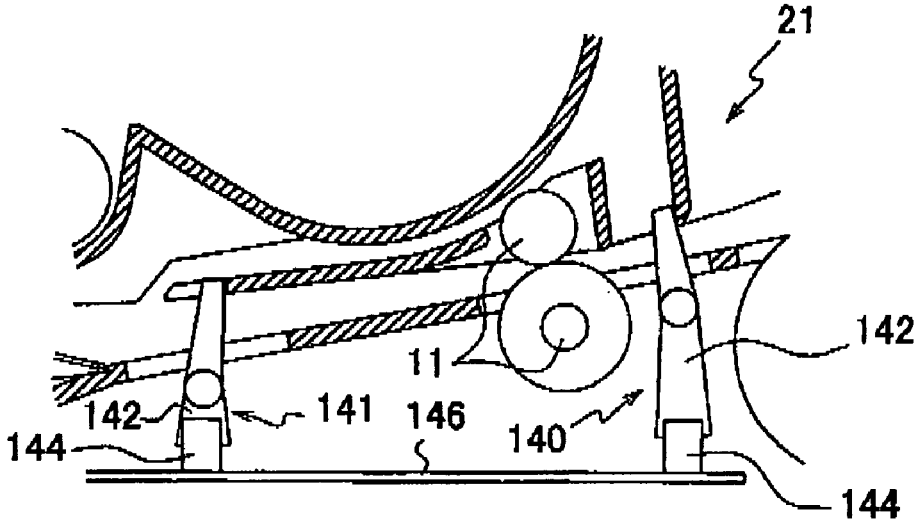
FIG. 20A is a cross-sectional view showing the process cartridge mounted on the laser printer according to a modification of the embodiment.
Figure 20B:
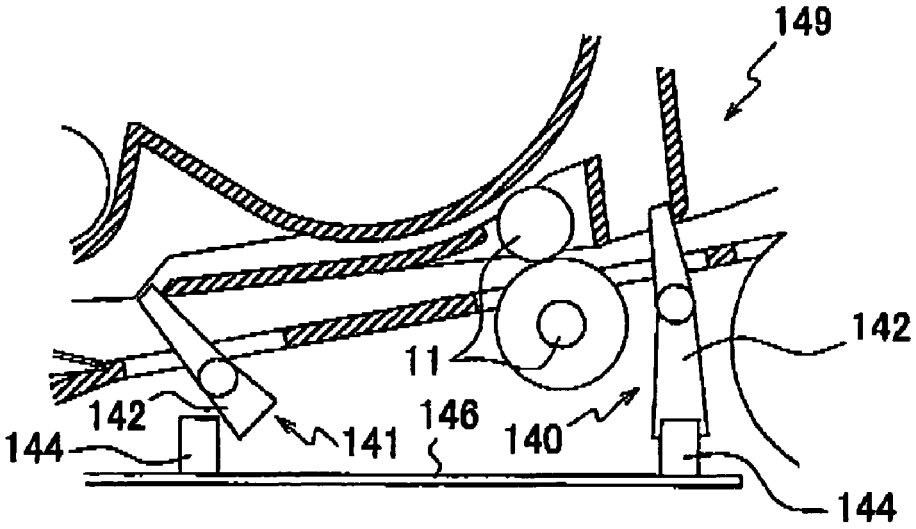
FIG. 20B is a cross-sectional view showing the inspection cartridge mounted on the laser printer according to the modification of the embodiment.

Alternatively, as shown in FIGS. 20A and 20B, the laser printer 1 may be configured so that only the sensing unit 140 is set to an ON state, and not the sensing unit 141, when the inspection cartridge 180 is mounted in the laser printer 1. The CPU 151 of the control unit 150 then determines that the process cartridge 21 is mounted in the laser printer 1 when both the sensing units 140 and 141 are in the ON state (the state shown in FIG. 20A), and determines that the inspection cartridge 180 is mounted when only the sensing unit 140 is in the ON state (the state shown in FIG. 20B).

Accordingly, as with the laser printer 1 according to the second embodiment, it is possible to determine the type of cartridge using the sensing units 140 and 141 simply by modifying the shapes of each cartridge based on the type of cartridge. Therefore, the type of cartridge can be identified with a simple construction.

Further, since the cartridge detecting unit are also used as means for detecting the position of the sheet 3, the position of the sheet 3 can be detected without providing a new means for that purpose.

What is claimed is:

1. An image-forming device comprising:

a main casing;

a photosensitive member having a surface;

a charging unit that charges the surface of the photosensitive member;

an exposing unit that forms an electrostatic latent image on the surface of the photosensitive member after the photosensitive member has been charged by the charging unit;

a developing unit that develops the latent image formed on the surface of the photosensitive member into a visible image using a developer;

a transferring unit that transfers the visible image developed by the developer onto a recording medium;

an inspection member receiving section in which an inspection member is detachably mountable;

a driving unit that selectively drives the charging unit, the developing unit, and the transferring unit as a target unit to be driven;

a switching unit that switches an operating mode between a normal mode for forming images on the recording medium and a self-diagnostic mode for performing a self-diagnosis, the switching unit switching from the normal mode to the self-diagnostic mode when the inspection member is mounted in the inspection member receiving section;

a drive commanding unit that outputs a self-diagnostic drive command to the driving unit to command the driving unit to drive the target unit when the switching unit has switched to the self-diagnostic mode; and a diagnosing unit that determines whether an operating state of the driving unit is normal based on drive commands received from the drive commanding unit, wherein the inspection member receiving section is further configured to couple the inspection member to the driving unit when the inspection member is mounted in the inspection member receiving section.

2. The image-forming device according to claim 1, further comprising an image-forming cartridge including at least the target unit to be driven by the driving unit, the image-forming cartridge being detachably mounted in a predetermined position, wherein the driving unit is disposed on the main casing so as to be capable of connecting electrically to the target unit provided in the image-forming cartridge when the image-forming cartridge is mounted in the predetermined position.

3. The image-forming device according to claim 2, wherein the inspection member comprises an inspection cartridge that is mountable in place of the image-forming cartridge.

4. The image-forming device according to claim 3, further comprising an identifying unit that identifies a type of cartridge mounted, wherein the switching unit switches the operating mode to the self-diagnostic mode when the identifying unit identifies the mounted cartridge to be the inspection cartridge, and to the normal mode when the identifying unit identifies the mounted cartridge to be the image-forming cartridge.

5. The image-forming device according to claim 4, wherein the inspection cartridge has a smaller electrical resistance than an electrical resistance in the target unit provided in the image-forming cartridge.

6. The image-forming device according to claim 4, wherein the inspection cartridge has an internal state different from an internal state of the image-forming cartridge, the identifying unit identifying the type of the cartridge by detecting the internal state of the cartridge mounted in the predetermined position.

7. The image-forming device according to claim 6, wherein the identifying unit comprises a new product detecting unit that detects whether the cartridge mounted in the predetermined position is new, and a developer detecting unit that detects whether the cartridge mounted in the predetermined position contains developer, wherein the identifying unit determines that the inspection cartridge is mounted in the predetermined position when the new product detecting unit detects that the cartridge is new and the developer detecting unit determines that the cartridge does not contain developer.

8. The image-forming device according to claim 7, wherein when the identifying unit determines that the image-forming cartridge is mounted in the predetermined position, the identifying unit provides a detection output based on a usage state of the cartridge detected by the new product detecting unit and the developer detecting unit.

9. The image-forming device according to claim 7, wherein when the identifying unit determines that the inspection cartridge is mounted in the predetermined position, the identifying unit provides a detection output produced regardless of a usage state of the cartridge detected by the new product detecting unit and the developer detecting unit, the detection output indicating that the cartridge is new and that the cartridge does not contain developer.

10. The image-forming device according to claim 4, wherein the identifying unit comprises a first cartridge detecting unit that changes a detection status when one of the image-forming cartridge and the inspection cartridge is mounted in the predetermined position, and a second cartridge detecting unit that changes a detection status when another of the image-forming cartridge and the inspection cartridge is mounted in the predetermined position, wherein the type of cartridge mounted in the predetermined position is identified based on detection results by the first and second cartridge detecting units.

11. The image-forming device according to claim 10, wherein the first and second cartridge detecting units are disposed along a conveying path on which the recording medium is conveyed, a position of the recording medium being detected from changes in a detection status of the first and second cartridge detecting units when the recording medium passes the position, wherein the first cartridge detecting unit is disposed downstream of the second cartridge detecting unit with respect to the direction in which the recording medium is conveyed, and the detection status is changed when the image-forming cartridge is mounted in the predetermined position, and wherein the identifying unit identifies the type of cartridge mounted in the predetermined position as the inspection cartridge when the detection status is changed by the first cartridge detecting unit but not changed by the second cartridge detecting unit.

12. The image-forming device according to claim 1, wherein the driving unit comprises a voltage applying unit that applies a drive voltage to the target unit to be driven, wherein the drive commanding unit outputs a self-diagnostic drive command for commanding the voltage applying unit to output a voltage of a size not outputted during the normal mode.

13. The image-forming device according to claim 12, wherein the driving unit drives a plurality of target units and the drive commanding unit outputs a drive command to the voltage applying unit that commands the voltage applying unit to output a combination of voltages not output during the normal mode to each of the target units.

14. The image-forming device according to claim 1, further comprising a reporting unit that reports externally the results of diagnoses performed by the diagnostic unit.

15. The image-forming device according to claim 1, further comprising a storing unit that stores results of diagnoses performed by the diagnostic unit, and a transmitting unit that transmits diagnostic results stored in the storing unit externally.

16. The image-forming device according to claim 1, further comprising a cleaning unit that cleans the surface of the photosensitive member.

17. The image-forming device according to claim 16, wherein the cleaning unit is included in the target unit.

18. An image-forming device comprising:

a main casing;

a photosensitive member having a surface;

a charging unit that charges the surface of the photosensitive member;

an exposing unit that forms an electrostatic latent image on the surface of the photosensitive member after the photosensitive member has been charged by the charging unit;

a developing unit that develops the latent image formed on the surface of the photosensitive member into a visible image using a developer;

a transferring unit that transfers the visible image developed by the developer onto a recording medium;

an inspection member receiving section in which an inspection member is detachably mountable;

a driving unit that selectively drives the charging unit, the developing unit, and the transferring unit as a target unit to be driven;

a switching unit that switches an operating mode between a normal mode for forming images on the recording medium and a self-diagnostic mode for performing a self-diagnosis based on whether the inspection member is mounted in the inspection member receiving section;

a drive commanding unit that outputs a self-diagnostic drive command to the driving unit to command the driving unit to drive the target unit when the switching unit has switched to the self-diagnostic mode;

a diagnosing unit that determines whether an operating state of the driving unit is normal based on drive commands received from the drive commanding unit; and an image-forming cartridge including at least the target unit to be driven by the driving unit, the image-forming cartridge being detachably mounted in a predetermined position, wherein the driving unit is disposed on the main casing so as to be capable of connecting electrically to the target unit provided in the image-forming cartridge when the image-forming cartridge is mounted in the predetermined position, wherein the inspection member comprises an inspection cartridge that is mountable in place of the image-forming cartridge.

* * * * *